US011635252B2

(12) United States Patent
Liu et al.

(10) Patent No.: US 11,635,252 B2
(45) Date of Patent: Apr. 25, 2023

(54) PRIMARY LOOP START-UP METHOD FOR A HIGH PRESSURE EXPANDER PROCESS

(71) Applicants: Yijun Liu, Spring, TX (US); Fritz Pierre, Jr., Humble, TX (US); Ananda K. Nagavarapu, Houston, TX (US); Xiaoli Y. Wright, Sugar Land, TX (US)

(72) Inventors: Yijun Liu, Spring, TX (US); Fritz Pierre, Jr., Humble, TX (US); Ananda K. Nagavarapu, Houston, TX (US); Xiaoli Y. Wright, Sugar Land, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 604 days.

(21) Appl. No.: 16/526,446

(22) Filed: Jul. 30, 2019

(65) Prior Publication Data

US 2020/0064062 A1 Feb. 27, 2020

Related U.S. Application Data

(60) Provisional application No. 62/721,375, filed on Aug. 22, 2018.

(51) Int. Cl.
*F25J 1/02* (2006.01)
*F25J 1/00* (2006.01)

(52) U.S. Cl.
CPC ..... *F25J 1/0035* (2013.01); *F25J 1/0022* (2013.01); *F25J 1/0243* (2013.01); *F25J 1/0244* (2013.01);
(Continued)

(58) Field of Classification Search
CPC ..... F25J 1/0022; F25J 1/0243; F25J 1/0244; F25J 1/0247; F25J 1/0254; F25J 2210/60; F25J 2280/10; F25B 45/00; F25B 45/26
See application file for complete search history.

(56) References Cited

U.S. PATENT DOCUMENTS 1,914,337 A 6/1933 Belt
1,974,145 A 9/1934 Atwell ..... 183/120
(Continued)

FOREIGN PATENT DOCUMENTS

CN 102628635 10/2014 ..... F25J 3/08
CN 106642985 5/2017
(Continued)

OTHER PUBLICATIONS

Fantolina, A. et al., (2012) "Use Dynamic Simulation for Advanced LNG Plant Design," Hydrological Processing, pp. 81-86.
(Continued)

*Primary Examiner* — Brian M King
(74) *Attorney, Agent, or Firm* — ExxonMobil Technology and Engineering Company

(57) ABSTRACT

A method is disclosed for start-up of a system for liquefying a feed gas stream comprising natural gas. The system has a feed gas compression and expansion loop, and a refrigerant system comprising a primary cooling loop and a sub-cooling loop. The feed gas compression and expansion loop is started up. The refrigerant system is pressurized. Circulation in the primary cooling loop is started and established. Circulation in the sub-cooling loop is started and established. A flow rate of the feed gas stream and circulation rates of the primary cooling loop and the sub-cooling loop are ramped up.

3 Claims, 10 Drawing Sheets

(52) U.S. Cl.
CPC ..... *F25J 1/0254* (2013.01); *F25J 1/0262* (2013.01); *F25J 2210/60* (2013.01); *F25J 2240/30* (2013.01)

(56) References Cited

U.S. PATENT DOCUMENTS

| | | | | |
|---|---|---|---|---|
| 2,007,271 | A | 7/1935 | Frankl | 62/175.5 |
| 2,011,550 | A | 8/1935 | Hasche | 62/121 |
| 2,321,262 | A | 6/1943 | Taylor | 62/140 |
| 2,475,255 | A | 7/1949 | Rollman | 62/170 |
| 2,535,148 | A * | 12/1950 | Martin | F25J 1/004 48/190 |
| 2,537,045 | A | 1/1951 | Garbo | 62/122 |
| 3,014,082 | A | 12/1961 | Woertz | 260/676 |
| 3,103,427 | A | 9/1963 | Jennings | 62/39 |
| 3,180,709 | A | 4/1965 | Yendall et al. | 23/210 |
| 3,347,055 | A | 10/1967 | Blanchard et al. | 62/9 |
| 3,370,435 | A | 2/1968 | Arregger | 62/28 |
| 3,400,512 | A | 9/1968 | McKay | 55/69 |
| 3,400,547 | A | 9/1968 | Williams et al. | 62/55 |
| 3,478,529 | A | 11/1969 | Boykin | |
| 3,511,058 | A | 5/1970 | Becker | 62/9 |
| 3,724,226 | A | 4/1973 | Pachaly | 62/39 |
| 3,878,689 | A | 4/1975 | Grenci | 62/9 |
| 4,281,518 | A | 8/1981 | Muller et al. | 62/12 |
| 4,415,345 | A | 11/1983 | Swallow | 62/28 |
| 4,609,388 | A | 9/1986 | Adler et al. | 62/12 |
| 4,769,054 | A | 9/1988 | Steigman | 62/12 |
| 5,025,860 | A | 6/1991 | Mandrin | 166/267 |
| 5,137,558 | A | 8/1992 | Agrawal | 62/24 |
| 5,139,547 | A | 8/1992 | Agrawal et al. | 62/8 |
| 5,141,543 | A | 8/1992 | Agrawal et al. | 62/8 |
| 5,638,698 | A | 6/1997 | Knight et al. | 62/632 |
| 5,651,269 | A * | 7/1997 | Prevost | F25J 3/0209 62/613 |
| 5,950,453 | A | 9/1999 | Bowen et al. | 62/612 |
| 6,003,603 | A | 12/1999 | Breivik et al. | 166/357 |
| 6,016,665 | A * | 1/2000 | Cole | C22C 38/001 62/612 |
| 6,023,942 | A * | 2/2000 | Thomas | F17C 1/002 62/613 |
| 6,158,242 | A | 12/2000 | Lu | 62/637 |
| 6,295,838 | B1 | 10/2001 | Shah et al. | 62/643 |
| 6,298,688 | B1 | 10/2001 | Brostow et al. | 62/613 |
| 6,308,531 | B1 | 10/2001 | Roberts et al. | |
| 6,412,302 | B1 * | 7/2002 | Foglietta | F25J 1/005 62/611 |
| 6,662,589 | B1 | 12/2003 | Roberts et al. | 62/425 |
| 6,889,522 | B2 | 5/2005 | Prible et al. | 62/612 |
| 7,127,914 | B2 | 10/2006 | Roberts et al. | |
| 7,143,606 | B2 | 12/2006 | Trainer | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbury | 62/620 |
| 7,712,331 | B2 | 5/2010 | Dee et al. | 62/612 |
| 8,079,321 | B2 | 12/2011 | Balasubramanian | 114/74 |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,616,021 | B2 | 12/2013 | Minta | |
| 8,747,520 | B2 | 6/2014 | Bearden et al. | 95/41 |
| 9,016,088 | B2 | 4/2015 | Butts | 62/613 |
| 9,121,636 | B2 | 9/2015 | Mock et al. | |
| 9,140,490 | B2 | 9/2015 | Minta et al. | |
| 9,339,752 | B2 | 5/2016 | Reddy et al. | B01D 53/002 |
| 9,435,229 | B2 | 9/2016 | Alekseev et al. | 60/643 |
| 9,439,077 | B2 | 9/2016 | Gupta et al. | H04W 12/12 |
| 9,459,042 | B2 | 10/2016 | Chantant et al. | 62/50.2 |
| 9,506,690 | B2 | 11/2016 | Paradowski et al. | |
| 2006/0000615 | A1 | 1/2006 | Choi | 166/352 |
| 2007/0277674 | A1 | 12/2007 | Hirano et al. | 95/290 |
| 2009/0217701 | A1 * | 9/2009 | Minta | F25J 1/0022 62/612 |
| 2010/0192626 | A1 | 8/2010 | Chantant | 62/606 |
| 2010/0251763 | A1 | 10/2010 | Audun | 62/614 |
| 2011/0036121 | A1 | 2/2011 | Roberts et al. | 62/612 |
| 2011/0126451 | A1 | 6/2011 | Pan et al. | 44/451 |
| 2011/0259044 | A1 | 10/2011 | Baudat et al. | 62/611 |
| 2012/0285196 | A1 | 11/2012 | Flinn et al. | 62/620 |
| 2012/0289407 | A1 * | 11/2012 | Nelson | F25J 1/0284 505/163 |
| 2013/0074541 | A1 | 3/2013 | Kaminsky et al. | 62/601 |
| 2013/0199238 | A1 | 8/2013 | Mock et al. | 62/611 |
| 2014/0130542 | A1 | 5/2014 | Brown et al. | 62/612 |
| 2014/0190205 | A1 * | 7/2014 | Bonnissel | F25J 1/0212 62/614 |
| 2015/0285553 | A1 | 10/2015 | Oelfke et al. | 62/611 |
| 2015/0300735 | A1 * | 10/2015 | Valencia | F25J 3/0266 62/637 |
| 2017/0010041 | A1 | 1/2017 | Pierre, Jr. et al. | 62/616 |
| 2017/0016667 | A1 | 1/2017 | Huntington et al. | 62/614 |
| 2017/0016668 | A1 | 1/2017 | Pierre, Jr. et al. | 62/614 |
| 2017/0160008 | A9 | 6/2017 | Kikkawa et al. | |
| 2018/0017320 | A1 * | 1/2018 | Bahari | F25J 1/0249 |
| 2018/0038643 | A1 * | 2/2018 | Roesch | F25J 1/0231 |
| 2018/0058753 | A1 * | 3/2018 | Mak | F25J 1/0254 |

FOREIGN PATENT DOCUMENTS

| | | | |
|---|---|---|---|
| DE | 1960515 | 5/1971 | F25J 1/02 |
| DE | 2354726 | 5/1975 | F17C 9/04 |
| DE | 3149847 | 7/1983 | B01D 5/00 |
| DE | 19906602 | 8/2000 | F25J 3/08 |
| DE | 102013007208 | 10/2014 | B01D 3/14 |
| EP | 1715267 | 10/2006 | F25J 3/02 |
| EP | 1972875 | 9/2008 | F25J 3/04 |
| EP | 2157013 | 8/2009 | F17C 3/02 |
| EP | 2629035 | 8/2013 | F25J 1/00 |
| FR | 2756368 | 5/1998 | B01D 53/26 |
| GB | 1376678 | 12/1974 | F25J 1/02 |
| GB | 1596330 | 8/1981 | F25J 1/02 |
| GB | 2172388 | 9/1986 | E21B 43/16 |
| GB | 2333148 | 7/1999 | F25J 1/02 |
| GB | 2470062 | 11/2010 | F25J 1/02 |
| GB | 2486036 | 11/2012 | F25J 1/02 |
| JP | 59216785 | 12/1984 | F25J 1/02 |
| JP | 2530859 | 4/1997 | G02F 1/13 |
| JP | 5705271 | 11/2013 | F25J 3/00 |
| JP | 5518531 | 6/2014 | Y02P 20/152 |
| KR | 2010/0112708 | 10/2010 | F17C 5/00 |
| KR | 2011/0079949 | 7/2011 | F25J 3/02 |
| WO | WO2006/120127 | 11/2006 | F25J 3/02 |
| WO | WO2008/133785 | 11/2008 | B63B 25/08 |
| WO | WO2011/101461 | 8/2011 | B63B 25/16 |
| WO | WO2012/031782 | 3/2012 | F25J 1/02 |
| WO | WO2014/048845 | 4/2014 | F25J 1/00 |
| WO | WO2015/110443 | 7/2015 | F25J 1/00 |
| WO | 2016/151636 | 9/2016 | |
| WO | WO2017/011123 | 1/2017 | F25J 3/08 |
| WO | WO2017/067871 | 4/2017 | F01D 15/10 |

OTHER PUBLICATIONS

Perez, V. et al., (1998) "The 4.5 MMTPA LNG Train—A Cost Effective Design//Train De GNL DE 4.5 MMTPA-UNE Conception Economique," International Conference and Exhibition on Liquefied Natural Gas, pp. 3.7-1-3.7-15.

Salisbury, Roy et al., (2007) "Design Manufacture, and Test Campaign of The World's Largest LNG Refrigeration Compressor Strings" International Conference and Exhibition on Liquefied Natural Gas, pp. 2.1-2.22.

U.S. Appl. No. 15/347,968, filed Nov. 10, 2016, Pierre, Fritz Jr. et al.

U.S. Appl. No. 15/347,983, filed Nov. 10, 2016, Pierre, Fritz Jr. et al.

U.S. Appl. No. 15/348,004, filed Nov. 10, 2016, Pierre, Fritz Jr. et al.

U.S. Appl. No. 15/348,533, filed Nov. 10, 2016, Pierre, Fritz Jr.

U.S. Appl. No. 62/458,127, filed Feb. 13, 2017, Pierre, Fritz Jr.

U.S. Appl. No. 62/458,131, filed Feb. 13, 2017, Pierre, Fritz Jr.

(56) References Cited

OTHER PUBLICATIONS

U.S. Appl. No. 62/463,274, filed Feb. 24, 2017, Kaminsky, Robert D. et al.
U.S. Appl. No. 62/478,961, Balasubramanian, Sathish.
Bach, Wilfried (1990) "Offshore Natural Gas Liquefaction with Nitrogen Cooling—Process Design and Comparison of Coil-Wound and Plate-Fin Heat Exchangers," Science and Technology Reports, No. 64, Jan. 1, 1990, pp. 31-37.
Chang, Ho-Myung et al, (2019) "Thermodynamic Design of Methane Liquefaction System Based on Reversed-Brayton Cycle" Cryogenics, pp. 226-234.
ConocoPhillips Liquefied Natural Gas Licensing (2017) "Our Technology And Expertise Are Ready To Work Toward Your LNG Future Today," http://lnglicensing.conocophillips.com/Documents/15-1106%20LNG%20Brochure_March2016.pdf, Apr. 25, 2017, 5 pgs.
Danish Technologies Institute (2017) "Project—Ice Bank System with Pulsating and Flexible Heat Exchanger (IPFLEX)," https://www.dti.dk/projects/project-ice-bank-system-with-pulsating-andflexible-heat-exchanger-ipflex/37176.
Diocee, T. S. et al. (2004) "Atlantic LNG Train 4-The Worlds Largest LNG Train", *The 14th International Conference and Exhibition on Liquefied Natural Gas* (*LNG 14*), Doha, Qatar, Mar. 21-24, 2004, 15 pgs.
Khoo, C. T. et al. (2009) "Execution of LNG Mega Trains—The Qatargas 2 Experience," *WCG*, 2009, 8 pages.
Laforte, C. et al. (2009) "Tensile, Torsional and Bending Strain at the Adhesive Rupture of an Iced Substrate," *ASME 28th Int'l Conf. on Ocean, Offshore and Arctic Eng.*, OMAE2009-79458, 8 pgs.
McLachlan, Greg (2002) "Efficient Operation of LNG From The Oman LNG Project," *Shell Global Solutions International B.V.*, Jan. 1, 2002, pp. 1-8.
Olsen, Lars et al. (2017).
Ott, C. M. et al. (2015) "Large LNG Trains: Technology Advances to Address Market Challenges", *Gastech*, Singapore, Oct. 27-30, 2015, 10 pgs.
Publication No. 43031 (2000) Research Disclosure, Mason Publications, Hampshire, GB, Feb. 1, 2000, p. 239, XP000969014, ISSN: 0374-4353, paragraphs [0004], [0005] & [0006].
Publication No. 37752 (1995) Research Disclosure, Mason Publications, Hampshire, GB, Sep. 1, 1995, p. 632, XP000536225, ISSN: 0374-4353, 1 page.
Ramshaw, Ian et al. (2009) "The Layout Challenges of Large Scale Floating LNG," *ConocoPhillips Global LNG Collaboration*, 2009, 24 pgs, XP009144486.
Riordan, Frank (1986) "A Deformable Heat Exchanger Separated by a Helicoid," *Journal of Physics A: Mathematical and General*, v. 19.9, pp. 1505-1515.
Roberts, M. J. et al. (2004) "Reducing LNG Capital Cost in Today's Competitive Environment", PS2-6, *The 14th International Conference and Exhibition on Liquefied Natural Gas* (*LNG 14*), Doha, Qatar, Mar. 21-24, 2004, 12 pgs.
Shah, Pankaj et al. (2013) "Refrigeration Compressor Driver Selection and Technology Qualification Enhances Value for the Wheatstone Project," *17th Int'l Conf. & Exh. on LNG*, 27 pgs.
Tan, Hongbo et al. (2016) "Proposal and Design of a Natural Gas Liquefaction Process Recovering the Energy Obtained from the Pressure Reducing Stations of High-Pressure Pipelines," *Cryogenics*, Elsevier, Kidlington, GB, v.80, Sep. 22, 2016, pp. 82-90.
Tsang, T. P. et al. (2009) "Application of Novel Compressor/Driver Configuration in the Optimized Cascade Process," *2009 Spring Mtg. and Global Conf. on Process Safety-9th Topical Conf. on Gas Utilization*, 2009, Abstract, 1 pg. https://www.aiche.org/conferences/aiche-spring-meeting-and-globalcongress-on-process-safety/2009/proceeding/paper/7a-application-novel-compressordriver-configurationoptimized-cascader-process.
Tianbiao, He et al. (2015), Optimal Synthesis of Expansion Liquefaction Cycle for Distributed-Scale LNG, *Institute of Refrigeration and Cryogenics, Shanghai Jiao Tong University*, pp. 268-280.

* cited by examiner

PRIMARY LOOP START-UP METHOD FOR A HIGH PRESSURE EXPANDER PROCESS

CROSS-REFERENCE TO RELATED APPLICATIONS

This application claims the priority benefit of U.S. Provisional Application No. 62/721,375, "Primary Loop Start-Up Method for a High Pressure Expander Process," filed Aug. 22, 2018; U.S. Provisional Application No. 62/565,725, "Natural Gas Liquefaction by a High Pressure Expansion Process", filed Sep. 29, 2017; U.S. Provisional Application No. 62/565,733, "Natural Gas Liquefaction by a High Pressure Expansion Process," filed Sep. 29, 2017; and U.S. Provisional Application No. 62/576,989, "Natural Gas Liquefaction by a High Pressure Expansion Process Using Multiple Turboexpander Compressors", filed Oct. 25, 2017, the disclosures of which are incorporated by reference herein in their entireties for all purposes.

This application is related to U.S. Provisional Application No. 62/721,367, "Managing Make-up Gas Composition Variation for a High Pressure Expander Process"; and U.S. Provisional Application No. 62/721,374, "Heat Exchanger Configuration for a High Pressure Expander Process and a Method of Natural Gas Liquefaction Using the Same," having common ownership and filed on an even date, the disclosures of which are incorporated by reference herein in their entireties for all purposes.

BACKGROUND

Field of Disclosure

The disclosure relates generally to liquefied natural gas (LNG) production. More specifically, the disclosure relates to LNG production at high pressures.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

Because of its clean burning qualities and convenience, natural gas has become widely used in recent years. Many sources of natural gas are located in remote areas, which are great distances from any commercial markets for the gas. Sometimes a pipeline is available for transporting produced natural gas to a commercial market. When pipeline transportation is not feasible, produced natural gas is often processed into liquefied natural gas (LNG) for transport to market.

In the design of an LNG plant, one of the most important considerations is the process for converting the natural gas feed stream into LNG. Currently, the most common liquefaction processes use some form of refrigeration system. Although many refrigeration cycles have been used to liquefy natural gas, the three types most commonly used in LNG plants today are: (1) the "cascade cycle," which uses multiple single component refrigerants in heat exchangers arranged progressively to reduce the temperature of the gas to a liquefaction temperature; (2) the "multi-component refrigeration cycle," which uses a multi-component refrigerant in specially designed exchangers; and (3) the "expander cycle," which expands gas from feed gas pressure to a low pressure with a corresponding reduction in temperature. Most natural gas liquefaction cycles use variations or combinations of these three basic types.

The refrigerants used in liquefaction processes may comprise a mixture of components such as methane, ethane, propane, butane, and nitrogen in multi-component refrigeration cycles. The refrigerants may also be pure substances such as propane, ethylene, or nitrogen in "cascade cycles." Substantial volumes of these refrigerants with close control of composition are required. Further, such refrigerants may have to be imported and stored, which impose logistics requirements, especially for LNG production in remote locations. Alternatively, some of the components of the refrigerant may be prepared, typically by a distillation process integrated with the liquefaction process.

The use of gas expanders to provide the feed gas cooling, thereby eliminating or reducing the logistical problems of refrigerant handling, is seen in some instances as having advantages over refrigerant-based cooling. The expander system operates on the principle that the refrigerant gas can be allowed to expand through an expansion turbine, thereby performing work and reducing the temperature of the gas. The low temperature gas is then heat exchanged with the feed gas to provide the refrigeration needed. The power obtained from cooling expansions in gas expanders can be used to supply part of the main compression power used in the refrigeration cycle. The typical expander cycle for making LNG operates at the feed gas pressure, typically under about 6,895 kPa (1,000 psia). Supplemental cooling is typically needed to fully liquefy the feed gas and this may be provided by additional refrigerant systems, such as secondary cooling and/or sub-cooling loops. For example, U.S. Pat. No. 6,412,302 and U.S. Pat. No. 5,916,260 present expander cycles which describe the use of nitrogen as refrigerant in the sub-cooling loop.

Previously proposed expander cycles have all been less efficient thermodynamically, however, than the current natural gas liquefaction cycles based on refrigerant systems. Expander cycles have therefore not offered any installed cost advantage to date, and liquefaction cycles involving refrigerants are still the preferred option for natural gas liquefaction.

Because expander cycles result in a high recycle gas stream flow rate and high inefficiency for the primary cooling (warm) stage, gas expanders have typically been used to further cool feed gas after it has been pre-cooled to temperatures well below −20° C. using an external refrigerant in a closed cycle, for example. Thus, a common factor in most proposed expander cycles is the requirement for a second, external refrigeration cycle to pre-cool the gas before the gas enters the expander. Such a combined external refrigeration cycle and expander cycle is sometimes referred to as a "hybrid cycle." While such refrigerant-based pre-cooling eliminates a major source of inefficiency in the use of expanders, it significantly reduces the benefits of the expander cycle, namely the elimination of external refrigerants.

U. S. Patent Application US2009/0217701 introduced the concept of using high pressure within the primary cooling loop to eliminate the need for external refrigerant and improve efficiency, at least comparable to that of refrigerant-based cycles currently in use. The high pressure expander process (HPXP), disclosed in U.S. Patent Application US2009/0217701, is an expander cycle which uses high pressure expanders in a manner distinguishing from other expander cycles. A portion of the feed gas stream may be extracted and used as the refrigerant in either an open loop or closed loop refrigeration cycle to cool the feed gas stream below its critical temperature. Alternatively, a portion of LNG boil-off gas may be extracted and used as the refrigerant in a closed loop refrigeration cycle to cool the feed gas stream below its critical temperature. This refrigeration cycle is referred to as the primary cooling loop. The primary cooling loop is followed by a sub-cooling loop which acts to further cool the feed gas. Within the primary cooling loop, the refrigerant is compressed to a pressure greater than 1,500 psia, or more preferably, to a pressure of approximately 3,000 psia. The refrigerant is then cooled against an ambient cooling medium (air or water) prior to being near isentropically expanded to provide the cold refrigerant needed to liquefy the feed gas.

FIG. 1 depicts an example of a known HPXP liquefaction process 100, and is similar to one or more processes disclosed in U. S. Patent Application US2009/0217701. In FIG. 1, an expander loop 102 (i.e., an expander cycle) and a sub-cooling loop 104 are used. Feed gas stream 106 enters the HPXP liquefaction process at a pressure less than about 1,200 psia, or less than about 1,100 psia, or less than about 1,000 psia, or less than about 900 psia, or less than about 800 psia, or less than about 700 psia, or less than about 600 psia. Typically, the pressure of feed gas stream 106 will be about 800 psia. Feed gas stream 106 generally comprises natural gas that has been treated to remove contaminants using processes and equipment that are well known in the art.

In the expander loop 102, a compression unit 108 compresses a refrigerant stream 109 (which may be a treated gas stream) to a pressure greater than or equal to about 1,500 psia, thus providing a compressed refrigerant stream 110. Alternatively, the refrigerant stream 109 may be compressed to a pressure greater than or equal to about 1,600 psia, or greater than or equal to about 1,700 psia, or greater than or equal to about 1,800 psia, or greater than or equal to about 1,900 psia, or greater than or equal to about 2,000 psia, or greater than or equal to about 2,500 psia, or greater than or equal to about 3,000 psia, thus providing compressed refrigerant stream 110. After exiting compression unit 108, compressed refrigerant stream 110 is passed to a cooler 112 where it is cooled by indirect heat exchange with a suitable cooling fluid to provide a compressed, cooled refrigerant stream 114. Cooler 112 may be of the type that provides water or air as the cooling fluid, although any type of cooler can be used. The temperature of the compressed, cooled refrigerant stream 114 depends on the ambient conditions and the cooling medium used, and is typically from about 35° F. to about 105° F. Compressed, cooled refrigerant stream 114 is then passed to an expander 116 where it is expanded and consequently cooled to form an expanded refrigerant stream 118. Expander 116 is a work-expansion device, such as a gas expander, which produces work that may be extracted and used for compression. Expanded refrigerant stream 118 is passed to a first heat exchanger 120, and provides at least part of the refrigeration duty for first heat exchanger 120. Upon exiting first heat exchanger 120, expanded refrigerant stream 118 is fed to a compression unit 122 for pressurization to form refrigerant stream 109.

Feed gas stream 106 flows through first heat exchanger 120 where it is cooled, at least in part, by indirect heat exchange with expanded refrigerant stream 118. After exiting first heat exchanger 120, the feed gas stream 106 is passed to a second heat exchanger 124. The principal function of second heat exchanger 124 is to sub-cool the feed gas stream. Thus, in second heat exchanger 124 the feed gas stream 106 is sub-cooled by sub-cooling loop 104 (described below) to produce sub-cooled stream 126. Sub-cooled stream 126 is then expanded to a lower pressure in expander 128 to form a liquid fraction and a remaining vapor fraction. Expander 128 may be any pressure reducing device, including, but not limited to a valve, control valve, Joule Thompson valve, Venturi device, liquid expander, hydraulic turbine, and the like. The sub-cooled stream 126, which is now at a lower pressure and partially liquefied, is passed to a surge tank 130 where the liquefied fraction 132 is withdrawn from the process as an LNG stream 134, which has a temperature corresponding to the bubble point pressure. The remaining vapor fraction (flash vapor) stream 136 may be used as fuel to power the compressor units.

In sub-cooling loop 104, an expanded sub-cooling refrigerant stream 138 (preferably comprising nitrogen) is discharged from an expander 140 and drawn through second and first heat exchangers 124, 120. Expanded sub-cooling refrigerant stream 138 is then sent to a compression unit 142 where it is re-compressed to a higher pressure and warmed. After exiting compression unit 142, the re-compressed sub-cooling refrigerant stream 144 is cooled in a cooler 146, which can be of the same type as cooler 112, although any type of cooler may be used. After cooling, the re-compressed sub-cooling refrigerant stream is passed to first heat exchanger 120 where it is further cooled by indirect heat exchange with expanded refrigerant stream 118 and expanded sub-cooling refrigerant stream 138. After exiting first heat exchanger 120, the re-compressed and cooled sub-cooling refrigerant stream is expanded through expander 140 to provide a cooled stream which is then passed through second heat exchanger 124 to sub-cool the portion of the feed gas stream to be finally expanded to produce LNG.

U.S. Patent Application US2010/0107684 disclosed an improvement to the performance of the HPXP through the discovery that adding external cooling to further cool the compressed refrigerant to temperatures below ambient conditions provides significant advantages which in certain situations justifies the added equipment associated with external cooling. The HPXP embodiments described in the aforementioned patent applications perform comparably to alternative mixed external refrigerant LNG production processes such as single mixed refrigerant processes. However, there remains a need to further improve the efficiency of the HPXP as well as overall train capacity. There remains a particular need to improve the efficiency of the HPXP in cases where the feed gas pressure is less than 1,200 psia.

U.S. Patent Application 2010/0186445 disclosed the incorporation of feed compression up to 4,500 psia to the HPXP. Compressing the feed gas prior to liquefying the gas in the HPXP's primary cooling loop has the advantage of increasing the overall process efficiency. For a given production rate, this also has the advantage of significantly reducing the required flow rate of the refrigerant within the primary cooling loop which enables the use of compact equipment, which is particularly attractive for floating LNG applications. Furthermore, feed compression provides a means of increasing the LNG production of an HPXP train by more than 30% for a fixed amount of power going to the primary cooling and sub-cooling loops. This flexibility in production rate is again particularly attractive for floating LNG applications where there are more restrictions than land based applications in matching the choice of refrigerant loop drivers with desired production rates.

For LNG production via an HPXP process, the refrigerant used in primary cooling loop needs to be built up during start-up procedures, and must also be made up during normal operation. In known processes, the primary cooling loop refrigerant make-up source may be feed gas, boil-off gas (BOG) from an LNG storage tank, or re-gasified LNG from an onshore or offshore storage facility. A direct charge of re-gasified LNG would require an ultra-lean composition that will not condense liquid during primary cooling loop start-up. Such constraint could adversely impact project schedule and cost. Additionally, the compositions of feed gas and/or BOG gas compositions could change with reservoir conditions and/or gas plant operation conditions. The changes in gaseous refrigerant composition could affect liquefaction performance, causing the process to deviate from optimum operating conditions. If using feed gas for start-up or make-up processes, the primary cooling loop refrigerant should have sufficiently low $C_{2+}$ content to stay at one phase before entering the suction sides of compressors and turboexpander compressors. Furthermore, liquid pooling in the primary loop passages of the main cryogenic heat exchanger could also cause gas mal-distribution, which is undesirable for efficient operation of the main cryogenic heat exchanger. Using BOG for start-up and make-up processes, on the other hand, could avoid the issues related to heavy components breakthrough. However, BOG is generally has much higher $N_2$ content than feed gas. Generally, too high of a nitrogen concentration negatively impacts the effectiveness of the primary loop refrigerant. In addition, the BOG composition is very sensitive to variations in composition of light ends such as nitrogen, hydrogen, helium in the feed gas. As shown in Table 1, an increase in the nitrogen concentration by 0.2% in the feed gas would result in an increase in BOG nitrogen concentration by 2%. For these reasons, there remains a need to manage variations in the feed gas composition during normal operation—both for the light contents (i.e., nitrogen, hydrogen, helium, etc.) and the heavy contents (i.e., $C_{2+}$). There is also a need to provide for efficient start-up operations of a high-pressure LNG liquefaction process.

TABLE 1

BOG Gas $N_2$ content sensitivity to the feed gas $N_2$ content variation

| | N2/(N2 + C1) | | | |
|---|---|---|---|---|
| Case | Scrubber Feed | Scrubber OVHD | LNG | BOG |
| Base | 0.56% | 0.56% | 0.23% | 5.8% |
| 1 | 0.61% | 0.62% | 0.25% | 6.3% |
| 2 | 067% | 0.67% | 0.27% | 6.9% |
| 3 | 0.72% | 0.73% | 0.29% | 7.4% |
| 4 | 0.78% | 0.78% | 0.31% | 7.9% |

The most convenient and cost-effective source of make-up gas would be feed gas from an upstream gas plant. However, depending on reservoir conditions, it shares the same concerns regarding heavy components. For these reasons, there remains a need to develop a cost-effective and reliable start-up process for an LNG liquefaction plant.

SUMMARY

A method is disclosed for start-up of a system for liquefying a feed gas stream comprising natural gas, according to disclosed aspects. The system has a feed gas compression and expansion loop, and a refrigerant system comprising a primary cooling loop and a sub-cooling loop. The feed gas compression and expansion loop is started up. The refrigerant system is pressurized. Circulation in the primary cooling loop is started and established. Circulation in the sub-cooling loop is started and established. A flow rate of the feed gas stream and circulation rates of the primary cooling loop and the sub-cooling loop are ramped up.

A method is disclosed for start-up of a system for liquefying a feed gas stream comprising natural gas, according to disclosed aspects. The system has a refrigerant system comprising a primary cooling loop and a sub-cooling loop. The refrigerant system is pressurized. Circulation in the primary cooling loop is started and established. Circulation in the sub-cooling loop is started and established. A flow rate of the feed gas stream and circulation rates of the primary cooling loop and the sub-cooling loop are ramped up.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
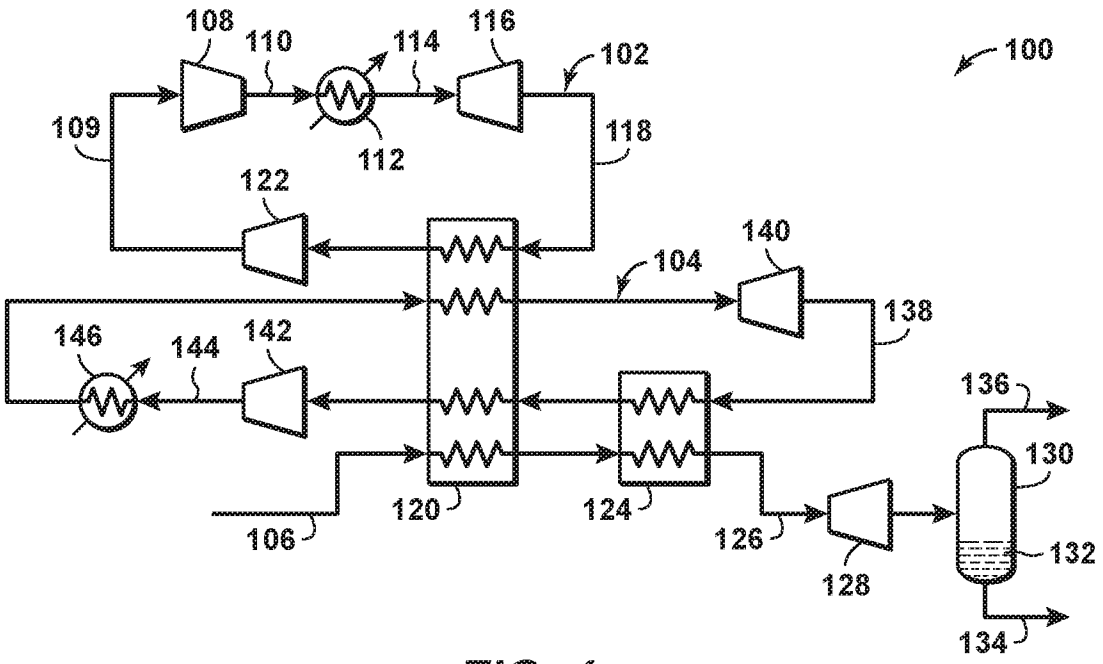
FIG. 1 (Prior Art)
FIG. 1 is a schematic diagram of a system for LNG production according to known principles.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake of clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure. The term "near" is intended to mean within 2%, or within 5%, or within 10%, of a number or amount.

As used herein, the term "ambient" refers to the atmospheric or aquatic environment where an apparatus is disposed. The term "at" or "near" "ambient temperature" as used herein refers to the temperature of the environment in which any physical or chemical event occurs plus or minus ten degrees, alternatively, five degrees, alternatively, three degrees, alternatively two degrees, and alternatively, one degree, unless otherwise specified. A typical range of ambient temperatures is between about 0° C. (32° F.) and about 40° C. (104° F.), though ambient temperatures could include temperatures that are higher or lower than this range. While it is possible in some specialized applications to prepare an environment with particular characteristics, such as within a building or other structure that has a controlled temperature and/or humidity, such an environment is considered to be "ambient" only where it is substantially larger than the volume of heat-sink material and substantially unaffected by operation of the apparatus. It is noted that this definition of an "ambient" environment does not require a static environment. Indeed, conditions of the environment may change as a result of numerous factors other than operation of the thermodynamic engine—the temperature, humidity, and other conditions may change as a result of regular diurnal cycles, as a result of changes in local weather patterns, and the like.

As used herein, "companders" means a combination of one or more compressors and one or more expanders.

As used herein, the term "compression unit" means any one type or combination of similar or different types of compression equipment, and may include auxiliary equipment, known in the art for compressing a substance or mixture of substances. A "compression unit" may utilize one or more compression stages. Illustrative compressors may include, but are not limited to, positive displacement types, such as reciprocating and rotary compressors for example, and dynamic types, such as centrifugal and axial flow compressors, for example.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

As used herein, "heat exchange area" means any one type or combination of similar or different types of equipment known in the art for facilitating heat transfer. Thus, a "heat exchange area" may be contained within a single piece of equipment, or it may comprise areas contained in a plurality of equipment pieces. Conversely, multiple heat exchange areas may be contained in a single piece of equipment.

A "hydrocarbon" is an organic compound that primarily includes the elements hydrogen and carbon, although nitrogen, sulfur, oxygen, metals, or any number of other elements can be present in small amounts. As used herein, hydrocarbons generally refer to components found in natural gas, oil, or chemical processing facilities.

As used herein, the terms "loop" and "cycle" are used interchangeably.

As used herein, "natural gas" means a gaseous feedstock suitable for manufacturing LNG, where the feedstock is a methane-rich gas. A "methane-rich gas" is a gas containing methane ($C_1$) as a major component, i.e., having a composition of at least 50% methane by weight. Natural gas may include gas obtained from a crude oil well (associated gas) or from a gas well (non-associated gas).

Disclosed aspects provide a method to start up a process for liquefying natural gas and other methane-rich gas streams to produce liquefied natural gas (LNG) and/or other liquefied methane-rich gases, where the liquefaction process includes a primary cooling loop and a sub-cooling loop. In one or more aspects, a separator is connected at the upstream of the primary cooling loop feeding a heat exchanger zone where feed gas is cooled to form a liquefied gas stream. A primary cooling loop refrigerant source stream, which comprises natural gas, a methane-rich gas stream, or their mixture with one or more of liquefied petroleum gas (LPG), boil-off gas (BOG), or nitrogen, is fed into the separator. The separator condenses out excessive heavy hydrocarbon components of the primary loop refrigerant source gas stream during startup steps, thereby producing a gaseous overhead refrigerant stream. The gaseous overhead refrigerant stream feeds the primary recooling loop path of the heat exchanger zone.

In a first aspect of the disclosure, the primary cooling loop is started first and charged directly with a feed gas stream. Such a start-up method comprises the steps of pressurizing the refrigerant system, starting and establishing circulation in the primary cooling loop, starting and establishing circulation in the sub-cooling loop circulation, and ramping up flow rates.

In a second aspect of the disclosure, the sub-cooling loop is charged first, and the feed gas is then chilled to generate overhead gas in the separator to feed the primary loop. This start-up method comprises the steps of pressurizing the refrigerant system, starting and establishing circulation in the sub-cooling loop, starting and establishing circulation in the primary loop, and ramping up flow rates.

In a third aspect of the disclosure, the sub-cooling loop is charged first, and the primary cooling loop is then started and charged with a feed gas stream. This start-up method comprises the steps of pressurizing the refrigerant systems, starting and establishing circulation in the sub-cooling loop, starting and establishing circulation in the primary loop, and ramping up flow rates.

In a fourth aspect of the disclosure, which is applicable for an open loop configuration, the primary loop is charged and started first. This start-up method comprises the steps of pressurizing the refrigerant systems, starting and establishing circulation in the primary cooling loop, starting and establishing circulation in the sub-cooling loop, and ramping up flow rates.

The first aspect of the disclosure may include the following steps: (1) providing a feed gas stream at a pressure less than 1,200 psia; (2) pressurize the feed gas path of the heat exchanger zone; (3) pressurize the sub-cooling loop to at most 90% of the lowest design pressure of sub-cooling loop using nitrogen, then close the circulation pass; (4) pressurize primary refrigerant loop to a pressure at most 90% of the lowest design pressure of primary refrigerant loop by feeding the gas stream to the primary loop, then close the circulation pass; (5) start the primary loop compressor with minimum speed and full recycle through ASV, thereby generating a suction pressure lower than and discharge pressure higher than the pressurized pressure of the primary loop; (6) gradually open the primary loop circulation pass downstream of the primary loop compressor to depressurize and cool down the gas inside the primary loop; (7) routing the depressurized and cooled primary gas to at least one separator to mix with the feed gas that is added to maintain the suction pressure targets during start-up, and condensing excessive heavy hydrocarbon components of the cooled primary gas stream and producing a gaseous overhead refrigerant stream; (8) passing the gaseous overhead refrigerant stream through the heat exchanger zone to cool at least part of the gas stream by indirect heat exchange, thereby forming a warm primary refrigerant; (9) compressing the warm primary refrigerant to produce the compressed primary loop refrigerant; (10) gradually increasing the primary cooling loop compressor discharge pressure to repeat step (5)-(9) while adding feed gas to maintain suction pressure of primary compressor, thereby gradually increasing primary cooling loop circulation rate; (11) starting companders in the primary loop when circulation rates reach the minimum required flow for compander operation; (12) establish steady state operation with only primary loop refrigerant; (13) starting the sub-cooling loop compressor with minimum speed and full recycle through ASV, thereby generating a suction pressure lower than and discharge pressure higher than the pressurized pressure of the subcooling loop; (14) routing the sub-cooling refrigerant, which may comprise nitrogen, to a heat exchange zone to warm at least part of the circulating primary refrigerant, thereby forming a cooled sub-cooling refrigerant; (16) gradually opening the sub-cooling circulation pass downstream of the cooled sub-cooling refrigerant to depressurize and chill the cooled nitrogen, thereby forming a sub-cooling loop chilled refrigerant; (17) passing the sub-cooling chilled refrigerant to the heat exchanger zone to cool at least part of the gas stream by indirect heat exchange, thereby forming a warm sub-cooling refrigerant; (18) compressing the warm sub-cooling refrigerant to produce the compressed sub-cooling loop refrigerant; (19) gradually increasing sub-cooling compressor discharge pressure (20) adding sub-cooling loop refrigerant to the sub-cooling loop to maintain the suction pressure targets during start-up; (21) gradually increasing compressor discharge pressure to repeat step (13)-(20) while adding feed gas to maintain suction pressure of primary compressor, thereby gradually increasing primary loop circulation rate (22); starting companders in the sub-cooling loop when circulation rates reach the minimum required flow for compander operation; (23) establish steady state operation with both primary loop refrigerant and sub-cooling loop refrigerant circulations at design pressures and turndown rate conditions; and (24) gradually ramping up the feed gas rate and loop circulation rates to design flow rate.

The second aspect of the disclosure may include the following steps: providing the gas stream at a pressure less than 1,200 psia; (2) pressurize the feed gas path of a heat exchanger zone; (3) pressurize a sub-cooling loop to at most 90% of the lowest design pressure of sub-the cooling loop using a sub-cooling refrigerant such as nitrogen, then close the circulation pass; (4) pressurize the primary refrigerant loop to a pressure at most 90% of the lowest design pressure of primary refrigerant loop by feeding the gas stream to the primary loop, then closing the circulation pass; (5) Start the sub-cooling loop compressor with minimum speed and full recycle through ASV, thereby generating a suction pressure lower than and a discharge pressure higher than the pressurized pressure of the subcooling loop; (6) routing the sub-cooling refrigerant to the heat exchange zone to warm at least part of the circulating primary refrigerant, thereby forming a cooled sub-cooling refrigerant; (7) gradually opening the sub-cooling circulation pass downstream of the cooled sub-cooling refrigerant to depressurize and chill the cooled sub-cooling refrigerant, thereby forming a chilled sub-cooling refrigerant; (8) passing the chilled sub-cooling refrigerant to a heat exchanger zone to cool at least part of the gas stream by indirect heat exchange, thereby forming a warm sub-cooling refrigerant; (9) compressing the warm sub-cooling refrigerant to produce the compressed sub-cooling refrigerant; (10) gradually increasing the sub-cooling compressor discharge pressure; (11) adding nitrogen or additional sub-cooling refrigerant to the sub-cooling loop to maintain the suction pressure targets during start-up; (12) starting companders in the sub-cooling loop when circulation rates reach the minimum required flow for compander operation; (13) establish steady state operation with only sub-cooling loop refrigerant circulations; (14) de-pressurizing and further chilling part or all of the cooled feed gas; (15) routing the de-pressurized and cooled feed gas to at least one separator in the primary loop, wherein the separator condenses out to the bottom of the separator, or otherwise separates, excessive heavy hydrocarbon components of the cooled primary gas stream, thereby producing a gaseous overhead refrigerant stream; (16) gradually filling, cooling, and pressurizing the primary loop with the gaseous overhead refrigerant stream to a pressure of at most 90% of the lowest design pressure of primary refrigerant loop; (17) starting the primary loop compressor with minimum speed and full recycle through ASV, thereby generating a suction pressure lower than, and a discharge pressure higher than, the pressurized pressure of the primary loop; (18) gradually opening the primary loop circulation pass downstream of the primary loop compressor to de-pressurize and cool down the gas inside the primary loop; (19) routing the de-pressurized and cooled primary gas to the separator to mix with the de-pressurized and cooled feed gas that is added to maintain the suction pressure targets during start-up, thereby condensing out or otherwise separating excessive heavy hydrocarbon components of the cooled primary gas stream, and producing a gaseous overhead refrigerant stream; (20) passing the gaseous overhead refrigerant stream through the heat exchanger zone to cool at least part of the gas stream by indirect heat exchange, thereby forming a warm primary refrigerant; (21) compressing the warm primary refrigerant to produce the compressed primary loop refrigerant; (22) gradually increasing the primary compressor discharge pressure to repeat step (14)-(21) while adding feed gas to maintain suction pressure of the primary loop compressor, thereby gradually increasing the primary loop circulation rate; (23) starting companders in the primary loop when circulation rates reach the minimum required flow for compander operation; (24) establishing steady state operation with both primary loop refrigerant and sub-cooling loop refrigerant circulations at design pressures and turndown rate conditions; and (25) gradually ramping up the feed gas rate and loop circulation rates to a desired flow rate, which may be a design flow rate.

The third aspect of the disclosure may include the following steps: (1) providing the gas stream at a pressure less than 1,200 psia; (2) pressurizing the feed gas path of the heat exchanger zone; (3) pressurizing, using a refrigerant such as nitrogen, the sub-cooling loop to at most 90% of the lowest design pressure of the sub-cooling loop, then closing the circulation pass; (4) pressurizing the primary refrigerant loop to a pressure at most 90% of the lowest design pressure of primary refrigerant loop by feeding the gas stream to the primary loop, then closing the circulation pass; (5) starting the sub-cooling loop compressor with minimum speed and full recycle through ASV, generating a suction pressure lower than and discharge pressure higher than the pressurized pressure of the subcooling loop; (6) routing the nitrogen to the heat exchange zone to warm at least part of the circulating primary refrigerant, thereby forming a cooled nitrogen; (7) gradually opening the sub-cooling circulation pass downstream of the cooled nitrogen to de-pressurize and chill the cooled nitrogen, thereby forming a sub-cooling loop chilled refrigerant; (8) passing the sub-cooling chilled refrigerant to a heat exchanger zone to cool at least part of the gas stream by indirect heat exchange, thereby forming a warm nitrogen refrigerant; (9) compressing the warm nitrogen refrigerant to produce the compressed sub-cooling loop refrigerant; (10) gradually increasing the sub-cooling compressor discharge pressure; (11) adding nitrogen to sub-cooling loop to maintain the suction pressure targets during start-up; (12) starting companders in the sub-cooling loop when circulation rates reach the minimum required flow for compander operation; (13) establishing steady state operation with only sub-cooling loop refrigerant circulations; (14) starting the primary loop compressor with minimum speed and full recycle through ASV, thereby generating a suction pressure lower than, and a discharge pressure higher than, the pressurized pressure of the primary loop; (15) gradually opening the primary loop circulation pass downstream of the primary loop compressor to de-pressurize and cool down the gas stream inside the primary loop; (16) routing the depressurized and cooled primary gas to at least one separator wherein mixing with the feed gas that is added to maintain the suction pressure targets during start-up, condensing out excessive heavy hydrocarbon components of the cooled primary gas stream to the bottom, and producing a gaseous overhead refrigerant stream; (17) passing the gaseous overhead refrigerant stream through the heat exchanger zone to cool at least part of the gas stream by indirect heat exchange, thereby forming a warm primary refrigerant; (18) compressing the warm primary refrigerant to produce the compressed primary loop refrigerant; (19) gradually increasing the primary compressor discharge pressure to repeat step (13)-(18) while adding feed gas to maintain suction pressure of primary compressor, thereby gradually increasing primary loop circulation rate; (19) starts companders in the primary loop when circulation rates reach the minimum required flow for compander operation; (20) establish steady state operation with both primary loop refrigerant and sub-cooling loop refrigerant circulations at design pressures and turndown rate conditions; and (21) gradually ramping up the feed gas rate and loop circulation rates to design flow rate.

The fourth aspect of the disclosure may include the following steps: (1) providing the gas stream at a pressure less than 1,200 psia; (2) pressurizing the feed gas path of the heat exchanger zone; (3) pressurizing the sub-cooling loop to at most 90% of the lowest design pressure of sub-cooling loop using a sub-cooling refrigerant such as nitrogen, then closing the circulation pass; (4) pressurizing the primary refrigerant loop to a pressure of at most 90% of the lowest design pressure of the primary refrigerant loop by feeding the gas stream to the primary loop, then closing the circulation pass; (5) starting the primary loop compressor with minimum speed and full recycle through ASV, generating a suction pressure lower than and discharge pressure higher than the pressurized pressure of the primary loop; (6) gradually opening the primary loop circulation pass downstream of primary loop compressor to depressurize and cool down the gas inside primary loop; (7a) separating the depressurized, cooled second gas stream into a first depressurized gas stream and a chilled gas stream (7b) depressurizing the first depressurized gas stream to produce a second depressurized gas stream; (7c) routing the second depressurized gas stream to at least one separator, thereby condensing out excessive heavy hydrocarbon components of the second expanded refrigerant and producing a gaseous overhead refrigerant stream; (8) passing the gaseous overhead refrigerant stream through the heat exchanger zone to cool at least part of the chilled gas stream by indirect heat exchange, thereby forming a warm primary refrigerant stream; (9) compressing the warm primary refrigerant stream to produce the compressed primary loop refrigerant stream; (10) gradually increasing the primary compressor discharge pressure to repeat step (5)-(9) while adding the feed gas to maintain the suction pressure of the feed compressor, thereby gradually increasing the primary loop circulation rate; (11) starting companders in the primary loop when circulation rates reach the minimum required flow for compander operation; (12) establishing steady state operation with only the primary loop refrigerant; (13) starting the sub-cooling loop compressor with minimum speed and full recycle through ASV, thereby generating a suction pressure lower than, and a discharge pressure higher than, the pressurized pressure of the subcooling loop; (14) routing the sub-cooling refrigerant to the heat exchange zone to warm at least part of the circulating primary refrigerant, thereby forming a cooled sub-cooling refrigerant; (16) gradually opening the sub-cooling circulation pass downstream of the cooled sub-cooling refrigerant to depressurize and chill the cooled sub-cooling refrigerant, thereby forming a sub-cooling loop chilled refrigerant; (17) passing the sub-cooling chilled refrigerant to the heat exchanger zone to cool at least part of the gas stream by indirect heat exchange, thereby forming a warm sub-cooling refrigerant; (18) compressing the warm sub-cooling refrigerant to produce the compressed sub-cooling loop refrigerant; (19) gradually increasing the sub-cooling compressor discharge pressure; (20) adding sub-cooling refrigerant to the sub-cooling loop to maintain the suction pressure targets during start-up; (21) starting companders in the sub-cooling loop when circulation rates reach the minimum required flow for compander operation; (22) establishing steady state operation with both the primary loop refrigerant and the sub-cooling loop refrigerant circulations at design pressures and turndown rate conditions; and (23) gradually ramping up the feed gas rate and loop circulation rates to a desired flow rate, which may be a design flow rate.

One or more of the disclosed aspects may include compressing the feed gas stream to a pressure no greater than 1,600 psia and then cooling the compressed gas stream by indirect heat exchange with an ambient temperature air or water prior to providing the feed gas stream for the start-up process. One or more of the disclosed aspects may include cooling the feed gas stream to a temperature below an ambient temperature by indirect heat exchange within an external cooling unit prior to providing the feed gas stream for the start-up process. One or more of the disclosed aspects may include depressurizing the feed stream to a lower pressure prior to providing the feed gas stream for the start-up process. One or more of the disclosed aspects may include cooling the compressed, cooled refrigerant to a temperature below the ambient temperature by indirect heat exchange with an external cooling unit prior to directing the compressed, cooled refrigerant to a second heat exchanger zone. These described additional steps may be employed singularly or in combination with each other.

The disclosed aspects have several advantages over known liquefaction start-up processes. In known liquefaction systems, the feed gas stream must be consistently sufficiently lean to be used to start up primary refrigerant loop. Alternatively, large quantities of LNG must be procured offsite to generate sufficient BOG or flash gas for the start-up process. A heating source and heat transfer equipment may also be required for BOG or flash gas operation to speed up the primary loop coolant generation necessary for the start-up process. In addition, BOG or flash gas generally has a much higher nitrogen content than the feed gas. High nitrogen concentration in the primary cooling loop negatively impacts the effectiveness of the primary cooling loop refrigerant, either by demanding higher power consumption or by requiring a larger main cryogenic heat exchanger. The disclosed aspects, in contrast, enable the use of a wide range of feed gas (from lean to rich) to start up the primary cooling loop. Compared to the use of BOG to start up and liquefy such semi-lean or rich feed gas streams using a comparable configuration used in known start-up processes, the size of main cryogenic heat exchanger is reduced by 10-16% and thermal efficiency improved up to about 1%. Compared to BOG or flash gas generated from LNG procured offsite, the disclosed aspects also offer flexibility in inventorying light (e.g., nitrogen) and heavy (e.g., $C_{2+}$) contents for the primary refrigerant loop that could better match feed gas from gas wells, to thereby optimize energy use or increase production rate.

Figure 2:
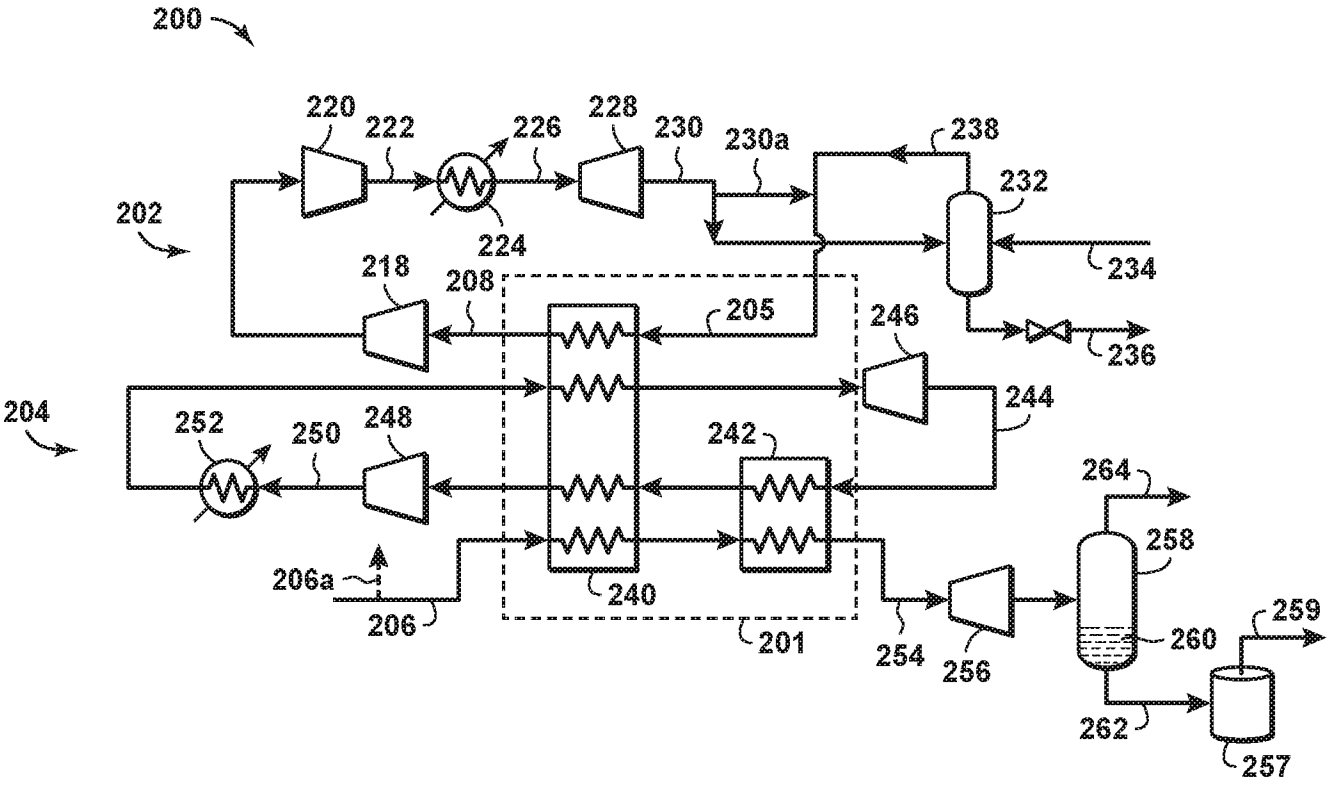
FIG. 2 is a schematic diagram of a system for LNG production according to disclosed aspects.

FIG. 2 is a schematic diagram that illustrates a liquefaction system 200 according to an aspect of the disclosure. The liquefaction system 200 includes a primary cooling loop 202, which may also be called an expander loop. The liquefaction system also includes a sub-cooling loop 204, which is a closed refrigeration loop preferably charged with nitrogen as the sub-cooling refrigerant. Within the primary cooling loop 202, a refrigerant stream 205 is directed to a heat exchanger zone 201 where it exchanges heat with a feed gas stream 206 to form a first warm refrigerant stream 208. The first warm refrigerant stream 208 is compressed in one or more compression units 218, 220 to a pressure greater than 1,500 psia, or more preferably, to a pressure of approximately 3,000 psia, to form a compressed refrigerant stream 222. The compressed refrigerant stream 222 is then cooled against an ambient cooling medium (air or water) in a cooler 224 to produce a compressed, cooled refrigerant stream 226. Cooler 224 may be similar to cooler 112 as previously described. The compressed, cooled refrigerant stream 226 is near isentropically expanded in an expander 228 to produce an expanded, cooled refrigerant stream 230. Expander 228 may be a work-expansion device, such as a gas expander, which produces work that may be extracted and used for compression.

All or a portion of the expanded, cooled refrigerant stream 230 is directed to a separation vessel 232. A make-up gas stream 234 is also directed to the separation vessel 232 and mixes therein with the expanded, cooled refrigerant stream 230. The rate at which the make-up gas stream 234 is added to the separation vessel 232 will depend on the rate of loss of refrigerant due to factors such as leaks from equipment seals. The mixing conditions the make-up gas stream 234 by condensing heavy hydrocarbon components (e.g., $C_{2+}$ compounds) contained in the make-up gas stream 234. The condensed components accumulate in the bottom of the separator and are periodically discharged as a separator bottom stream 236 to maintain a desired liquid level in the separation vessel 232. The conditioned make-up gas stream, minus the condensed heavy hydrocarbon components, exits the separation vessel as a gaseous overhead refrigerant stream 238. The gaseous overhead refrigerant stream 238 optionally mixes with a bypass stream 230*a* of the expanded, cooled refrigerant stream 230, forming the refrigerant stream 205.

The heat exchanger zone 201 may include a plurality of heat exchanger devices, and in the aspects shown in FIG. 2, the heat exchanger zone includes a main heat exchanger 240 and a sub-cooling heat exchanger 242. The main heat exchanger 240 exchanges heat with the refrigerant stream 205. These heat exchangers may be of a brazed aluminum heat exchanger type, a plate fin heat exchanger type, a spiral wound heat exchanger type, or a combination thereof. Within the sub-cooling loop 204, an expanded sub-cooling refrigerant stream 244 (preferably comprising nitrogen) is discharged from an expander 246 and drawn through the sub-cooling heat exchanger 242 and the main heat exchanger 240. Expanded sub-cooling refrigerant stream 244 is then sent to a compression unit 248 where it is re-compressed to a higher pressure and warmed. After exiting compression unit 248, the re-compressed sub-cooling refrigerant stream 250 is cooled in a cooler 252, which can be of the same type as cooler 224, although any type of cooler may be used. After cooling, the re-compressed sub-cooling refrigerant stream is passed through the main heat exchanger 240 where it is further cooled by indirect heat exchange with the refrigerant stream 205 and expanded sub-cooling refrigerant stream 244. After exiting the heat exchange area 201, the re-compressed and cooled sub-cooling refrigerant stream is expanded through expander 246 to provide the expanded sub-cooling refrigerant stream 244 that is re-cycled through the heat exchanger zone as described herein. In this manner, the feed gas stream 206 is cooled, liquefied and sub-cooled in the heat exchanger zone 201 to produce a sub-cooled gas stream 254. Sub-cooled gas stream 254 is then expanded to a lower pressure in an expander 256 to form a liquid fraction and a remaining vapor fraction. Expander 256 may be any pressure reducing device, including but not limited to a valve, control valve, Joule Thompson valve, Venturi device, liquid expander, hydraulic turbine, and the like. The sub-cooled stream 254, which is now at a lower pressure and partially liquefied, is passed to a surge tank 258 where the liquefied fraction 260 is withdrawn from the process as an LNG stream 262. The remaining vapor fraction, which is withdrawn from the surge tank as a flash vapor stream 264, may be used as fuel to power the compressor units.

Figure 3:
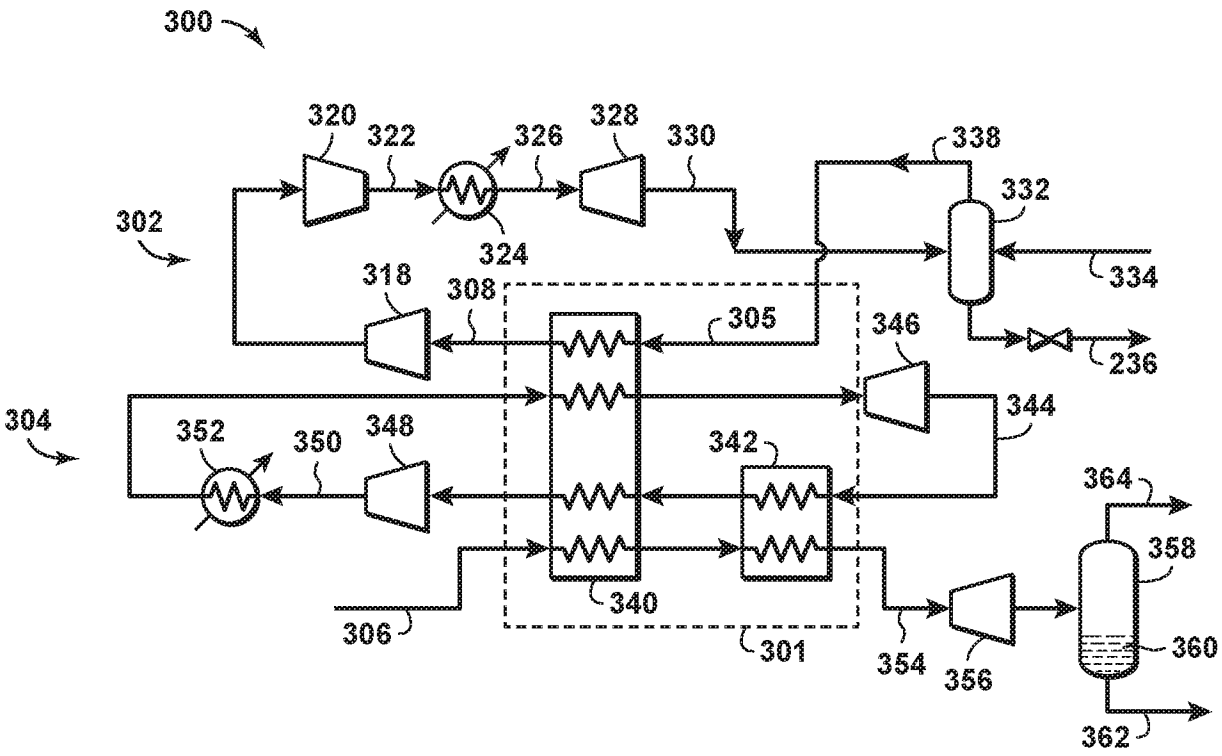
FIG. 3 is a schematic diagram of a system for LNG production according to disclosed aspects.

FIG. 3 is a schematic diagram that illustrates a liquefaction system 300 according to another aspect of the disclosure. Liquefaction system 300 is similar to liquefaction system 200 and for the sake of brevity similarly depicted or numbered components may not be further described. Liquefaction system 300 includes a primary cooling loop 302 and a sub-cooling loop 304. The sub-cooling loop 304 is a closed refrigeration loop preferably charged with nitrogen as the sub-cooling refrigerant. Liquefaction system 300 also includes a heat exchanger zone 301. Within the primary cooling loop 302, a refrigerant stream 305 is directed to the heat exchanger zone 301 where it exchanges heat with a feed gas stream 306 to form a first warm refrigerant stream 308. The first warm refrigerant stream 308 is compressed in one or more compression units 318, 320 to a pressure greater than 1,500 psia, or more preferably, to a pressure of approximately 3,000 psia, to form a compressed refrigerant stream 322. The compressed refrigerant stream 322 is then cooled against an ambient cooling medium (air or water) in a cooler 324 to produce a compressed, cooled refrigerant stream 326. Cooler 324 may be similar to cooler 112 as previously described. The compressed, cooled refrigerant stream 326 is near isentropically expanded in an expander 328 to produce an expanded, cooled refrigerant stream 330. Expander 328 may be a work-expansion device, such as a gas expander, which produces work that may be extracted and used for compression.

In contrast with liquefaction system 200, all of the expanded, cooled refrigerant stream 330 is directed to a separation vessel 332. A make-up gas stream 334 is also directed to the separation vessel 332 and mixes therein with the expanded, cooled refrigerant stream 330. The rate at which the make-up gas stream 334 is added to the separation vessel 332 will depend on the rate of loss of refrigerant due to such factors as leaks from equipment seals. The mixing conditions the make-up gas stream 334 by condensing heavy hydrocarbon components (e.g., $C_{2+}$ compounds) contained in the make-up gas stream 334. The condensed components accumulate in the bottom of the separator and are periodically discharged as a separator bottom stream 336 to maintain a desired liquid level in the separation vessel 332. The conditioned make-up gas stream, minus the condensed heavy hydrocarbon components, exits the separation vessel as a gaseous overhead refrigerant stream 338. The gaseous overhead refrigerant stream 338 forms the refrigerant stream 305.

The heat exchanger zone 301 may include a plurality of heat exchanger devices, and in the aspects shown in FIG. 3, the heat exchanger zone includes a main heat exchanger 340 and a sub-cooling heat exchanger 342. The main heat exchanger 340 exchanges heat with the refrigerant stream 305. These heat exchangers may be of a brazed aluminum heat exchanger type, a plate fin heat exchanger type, a spiral wound heat exchanger type, or a combination thereof. Within the sub-cooling loop 304, an expanded sub-cooling refrigerant stream 344 (preferably comprising nitrogen) is discharged from an expander 346 and drawn through the sub-cooling heat exchanger 342 and the main heat exchanger 340. Expanded sub-cooling refrigerant stream 344 is then sent to a compression unit 348 where it is re-compressed to a higher pressure and warmed. After exiting compression unit 348, the re-compressed sub-cooling refrigerant stream 350 is cooled in a cooler 352, which can be of the same type as cooler 324, although any type of cooler may be used. After cooling, the re-compressed sub-cooling refrigerant stream is passed through the main heat exchanger 340 where it is further cooled by indirect heat exchange with the refrigerant stream 305 and expanded sub-cooling refrigerant stream 344. After exiting the heat exchange area 301, the re-compressed and cooled sub-cooling refrigerant stream is expanded through expander 346 to provide the expanded sub-cooling refrigerant stream 344 that is re-cycled through the heat exchanger zone as described herein. In this manner, the feed gas stream 306 is cooled, liquefied and sub-cooled in the heat exchanger zone 301 to produce a sub-cooled gas stream 354. Sub-cooled gas stream 354 is then expanded to a lower pressure in an expander 356 to form a liquid fraction and a remaining vapor fraction. Expander 356 may be any pressure reducing device, including but not limited to a valve, control valve, Joule Thompson valve, Venturi device, liquid expander, hydraulic turbine, and the like. The sub-cooled stream 354, which is now at a lower pressure and partially liquefied, is passed to a surge tank 358 where the liquefied fraction 360 is withdrawn from the process as an LNG stream 362. The remaining vapor fraction, which is withdrawn from the surge tank as a flash vapor stream 364, may be used as fuel to power the compressor units.

Figure 4:
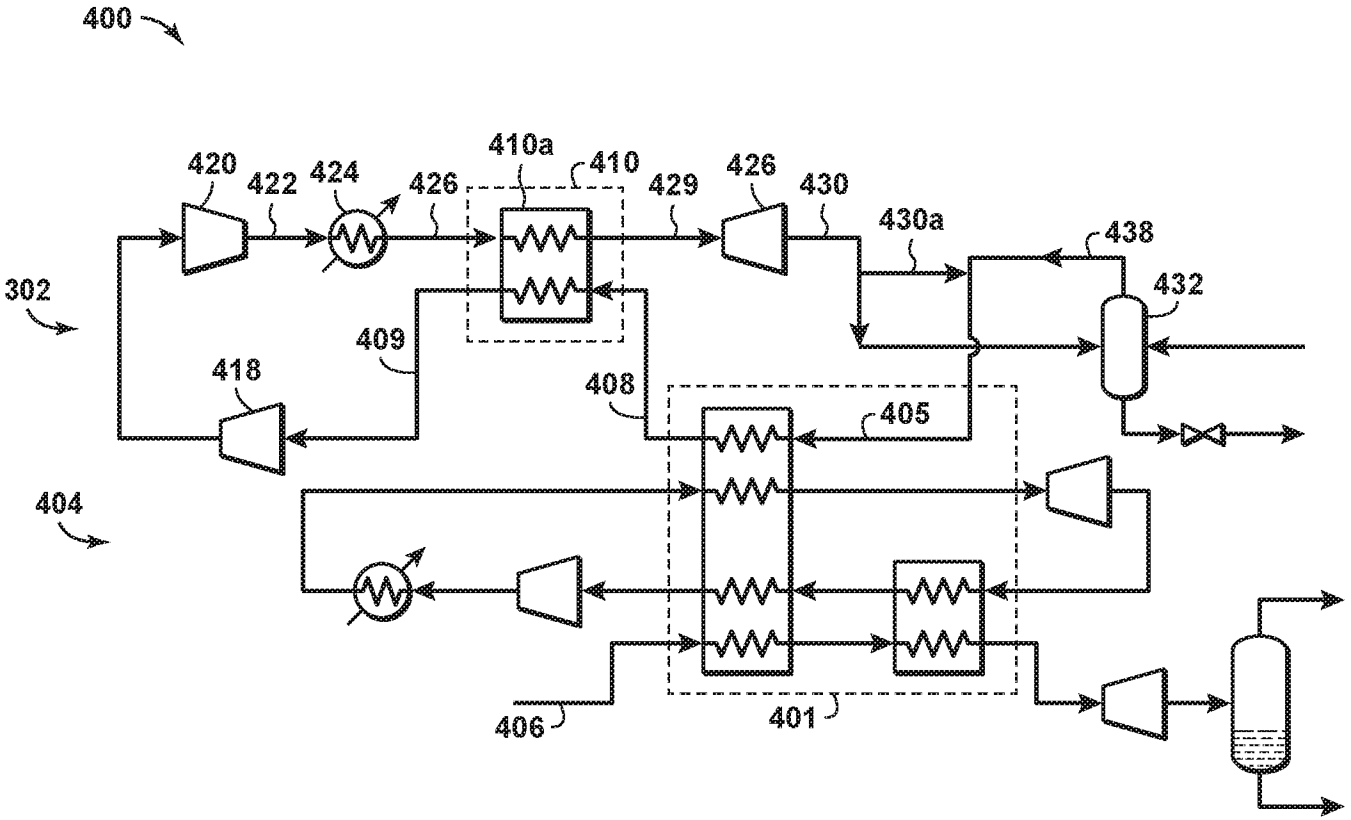
FIG. 4 is a schematic diagram of a system for LNG production according to disclosed aspects.

FIG. 4 is a schematic diagram that illustrates a liquefaction system 400 according to another aspect of the disclosure. Liquefaction system 400 is similar to liquefaction system 200, and for the sake of brevity similarly depicted or numbered components may not be further described. Liquefaction system 400 includes a primary cooling loop 402 and a sub-cooling loop 404. Liquefaction system 400 includes first and second heat exchanger zones 401, 410. Within the first heat exchanger zone 401, the first warm refrigerant stream 405 is used to liquefy the feed gas stream 406. One or more heat exchangers **410*a* within the second heat exchanger zone 410 uses all or a portion of the first warm refrigerant stream 408 to cool a compressed, cooled refrigerant stream 426, thereby forming a second warm refrigerant stream 409. The first heat exchanger zone 401 may be physically separate from the second heat exchanger zone 410**. Additionally, the heat exchangers of the first heat exchanger zone may be of a different type(s) from the heat exchangers of the second heat exchanger zone. Both heat exchanger zones may comprise multiple heat exchangers.

The first warm refrigerant stream 405 has a temperature that is cooler by at least 5° F., or more preferably, cooler by at least 10° F., or more preferably, cooler by at least 15° F., than the highest fluid temperature within the first heat exchanger zone 401. The second warm refrigerant stream 409 may be compressed in one or more compressors 418, 420 to a pressure greater than 1,500 psia, or more preferably, to a pressure of approximately 3,000 psia, to thereby form a compressed refrigerant stream 422. The compressed refrigerant stream 422 is then cooled against an ambient cooling medium (air or water) in a cooler 424 to produce the compressed, cooled refrigerant stream 426 that is directed to the second heat exchanger zone 410 to form a compressed, additionally cooled refrigerant stream 429. The compressed, additionally cooled refrigerant stream 429 is near isentropically expanded in an expander 428 to produce the expanded, cooled refrigerant stream 430. All or a portion of the expanded, cooled refrigerant stream 430 is directed to a separation vessel 432 where it is mixed with a make-up gas stream 434 as previously described with respect to FIG. 2. The rate at which the make-up gas stream 434 is added to the separation vessel 432 will depend on the rate of loss of refrigerant due to such factors as leaks from equipment seals. The conditioned make-up gas stream, minus the condensed heavy hydrocarbon components, exits the separation vessel as a gaseous overhead refrigerant stream 438. The gaseous overhead refrigerant stream 438 optionally mixes with a bypass stream 430*a* of the expanded, cooled refrigerant stream 430, forming the warm refrigerant stream 405.

Figure 5:
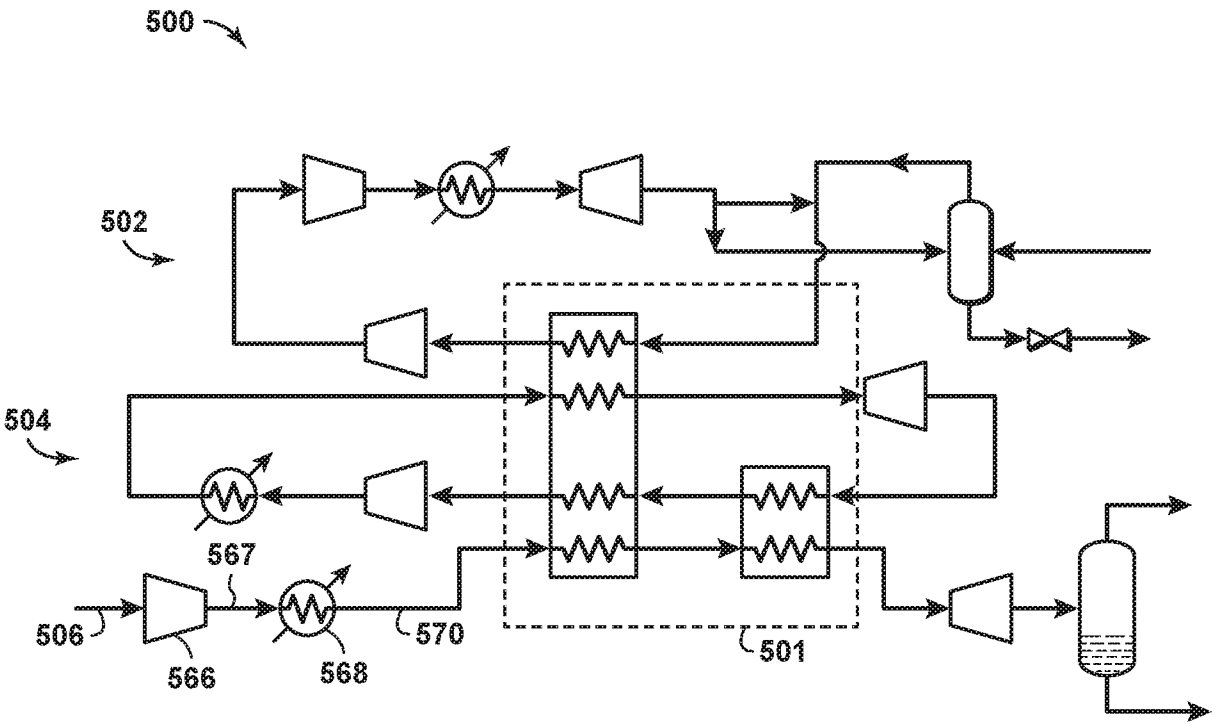
FIG. 5 is a schematic diagram of a system for LNG production according to disclosed aspects.

FIG. 5 is a schematic diagram that illustrates a liquefaction system 500 according to another aspect of the disclosure. Liquefaction system 500 is similar to liquefaction systems 200 and 300 and for the sake of brevity similarly depicted or numbered components may not be further described. Liquefaction system 500 includes a primary cooling loop 502 and a sub-cooling loop 504. Liquefaction system 500 also includes a heat exchanger zone 501. Liquefaction system 500 stream includes the additional steps of compressing the feed gas stream 506 in a compressor 566 and then, using a cooler 568, cooling the compressed feed gas 567 with ambient air or water to produce a cooled, compressed feed gas stream 570. Feed gas compression may be used to improve the overall efficiency of the liquefaction process and increase LNG production.

Figure 6:
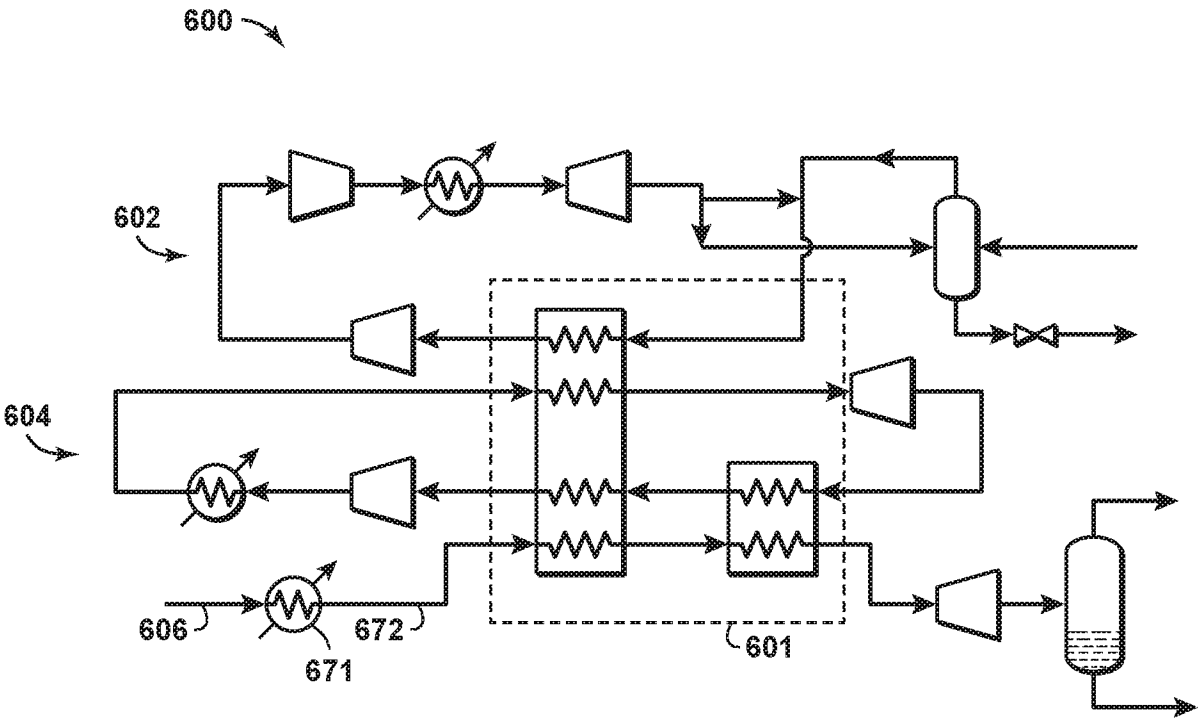
FIG. 6 is a schematic diagram of a system for LNG production according to disclosed aspects.

FIG. 6 is a schematic diagram that illustrates a liquefaction system 600 according to still another aspect of the disclosure. Liquefaction system 600 is similar to liquefaction systems 200 and 300 and for the sake of brevity similarly depicted or numbered components may not be further described. Liquefaction system 600 includes a primary cooling loop 602 and a sub-cooling loop 604. Liquefaction system 600 also includes a heat exchanger zone 601. Liquefaction system 600 includes the additional step of chilling, in an external cooling unit 665, the feed gas stream 606 to a temperature below the ambient temperature to produce a chilled gas stream 667. The chilled gas stream 667 is then directed to the first heat exchanger zone 601 as previously described. Chilling the feed gas as shown in FIG. 6 may be used to improve the overall efficiency of the liquefaction process and increase LNG production.

Figure 7:
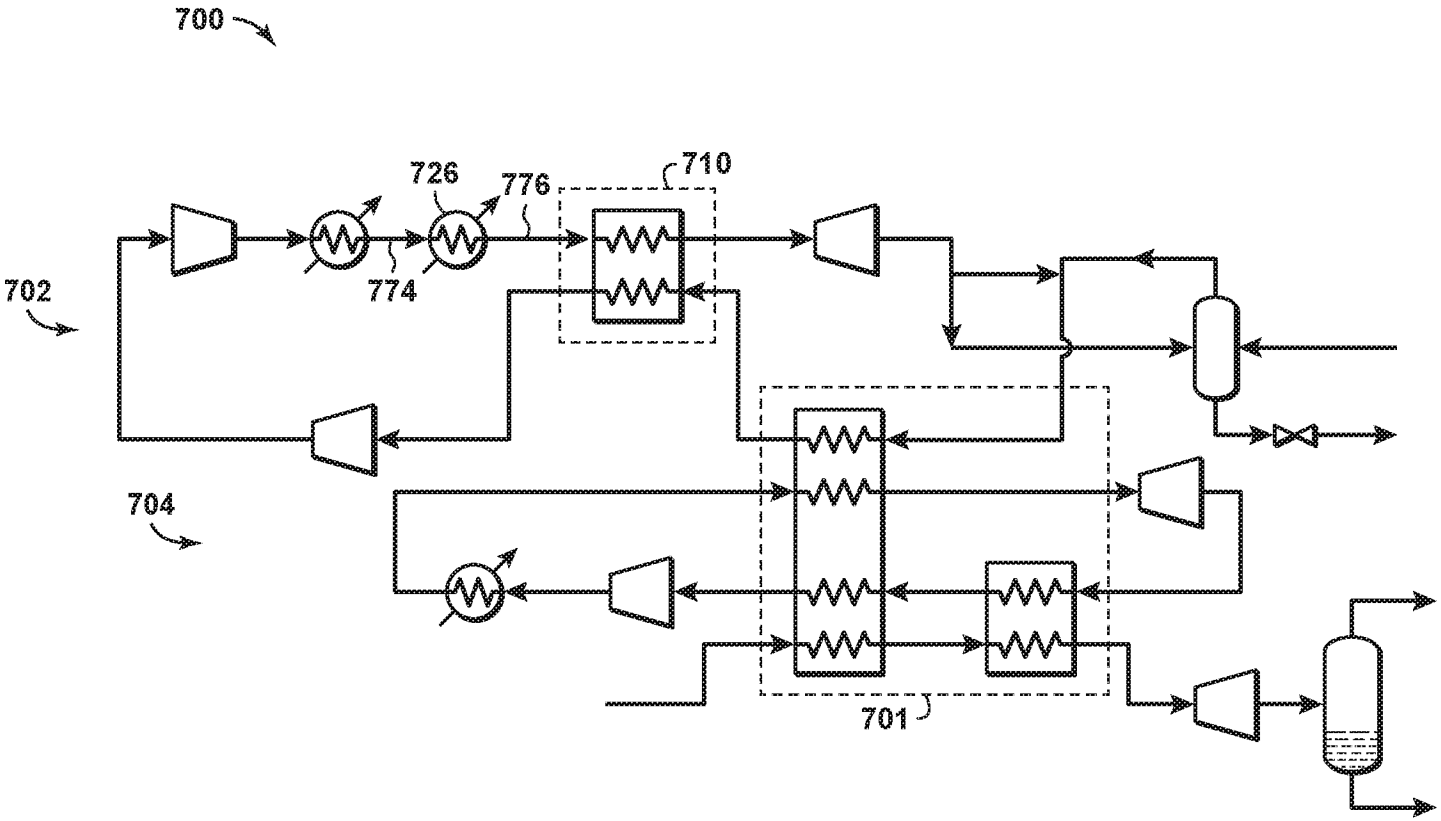
FIG. 7 is a schematic diagram of a system for LNG production according to disclosed aspects.

FIG. 7 is a schematic diagram that illustrates a liquefaction system 700 according to another aspect of the disclosure. Liquefaction system 700 is similar to liquefaction system 200 and for the sake of brevity similarly depicted or numbered components may not be further described. Liquefaction system 700 includes a primary cooling loop 702 and a sub-cooling loop 704. Liquefaction system 700 also includes first and second heat exchanger zones 701, 710. Liquefaction system 700 includes an external cooling unit 774 that chills the compressed, cooled refrigerant 726 in the primary cooling loop 702 to a temperature below the ambient temperature, to thereby produce a compressed, chilled refrigerant 776. The compressed, chilled refrigerant 776 is then directed to the second heat exchanger zone 710 as previously described. Using an external cooling unit to further cool the compressed, cool refrigerant may be used to improve the overall efficiency of the process and increase LNG production.

Figure 8:
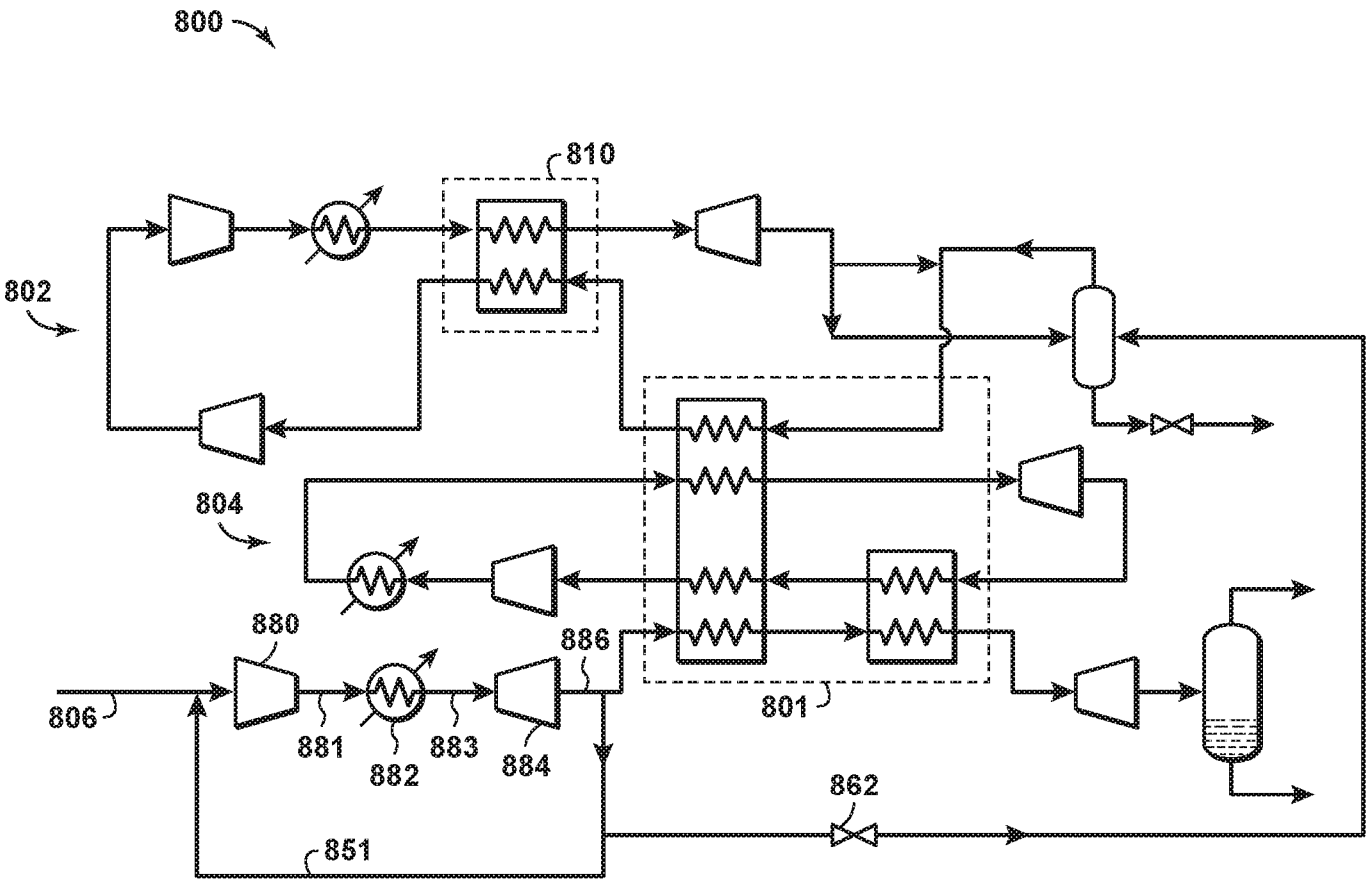
FIG. 8 is a schematic diagram of a system for LNG production according to disclosed aspects.

FIG. 8 is a schematic diagram that illustrates a liquefaction system 800 according to another aspect of the disclosure. Liquefaction system 800 is similar to liquefaction system 400 and for the sake of brevity similarly depicted or numbered components may not be further described. Liquefaction system 800 includes a primary cooling loop 802 and a sub-cooling loop 804. Liquefaction system 800 also includes first and second heat exchanger zones 801, 810. In liquefaction system 800, the feed gas stream 806 is compressed in a compressor 880 to a pressure of at least 1,500 psia, thereby forming a compressed gas stream 881. Using an external cooling unit 882, the compressed gas stream 881 is cooled by indirect heat exchange with an ambient temperature air or water to form a compressed, cooled gas stream 883. The compressed, cooled gas stream 883 is expanded in at least one work producing expander 884 to a pressure that is less than 2,000 psia but no greater than the pressure to which the gas stream was compressed, to thereby form a chilled gas stream 886. The chilled gas stream 886 is then directed to the first heat exchanger zone 801 where a primary cooling refrigerant and a sub-cooling refrigerant are used to liquefy the chilled gas stream as previously described.

Liquefaction system 800 further includes a feed gas compression and expansion loop 887 that is fed from a portion 888 of the chilled gas stream 886 during start-up operations as further disclosed herein. Portion 888 may also supply the make-up gas stream 834, which is an input to the separation vessel 832. A valve 889 controls flow of the portion 888 into the separation vessel.

According to disclosed aspects, a start-up method for the system 800 shown in FIG. 8 will now be described. It should be understood that the start-up methods disclosed herein are applicable to other systems 200-700 and 900.

A. Start Up the Feed Gas Compression and Expansion Loop

The start up process for the feed gas compression and expansion loop 887 includes execution of one or more of the following steps: (1) providing a feed gas stream 886 to pressurize the feed gas compression and expansion loop 887; (2) starting the compressor 880 with minimum speed and full recycle through its anti-surge valve (ASV), thereby generating a suction pressure lower than, and discharge pressure higher than, the pressurized pressure of the feed gas stream in the feed gas compression and expansion loop 887; (3) gradually permitting feed gas loop circulation downstream of the compressor 880 to be cooled by indirect heat exchange with an ambient temperature air or water in the external cooling unit 882 to form the compressed, cooled gas stream 883; (4) the compressed, cooled gas stream 883 is then depressurized and further cooled in the at least one work-producing expander 884 to produce the chilled gas stream 886; (5) routing the chilled gas stream 886 back to the suction side of the compressor 880 and mixing it with the feed gas stream 806 to maintain suction side pressure targets of the compressor 880; (6) gradually increasing the discharge pressure of the compressor 880; (7) starting the expander 884 of the feed expansion and compression loop 887 when feed gas circulation rates reach the minimum required flow for expander operation; and (8) establishing steady state circulation of feed expansion and compression loop 887.

B. Pressurizing the Refrigerant System

Pressurizing the refrigerant system includes the following steps: (9) pressurizing the sub-cooling loop 804 to at most 90% of the lowest design pressure of the sub-cooling loop using a sub-cooling refrigerant such as nitrogen, then restricting or closing the related circulation passage thereafter; (10) gradually opening valve 889 to pressurize the primary refrigerant loop 802 to a pressure of at most 90% of the lowest design pressure of the primary refrigerant loop 802 by feeding the portion 888 of the chilled gas stream 886 to the separation vessel 832 and thereby to the primary cooling loop 802, and then restricting or closing circulation thereafter.

C. Start and Establish Primary Loop Circulation

Starting and establishing circulation in the primary cooling loop 802 includes the following steps: (11) starting at least one of the one or more compressors 818, 820 in the primary cooling loop with minimum speed and full recycle through the respective ASV, generating a suction pressure lower than, and a discharge pressure higher than, the pressure of the primary cooling loop 802; (12) gradually permitting circulation in the primary loop downstream of the one or more compressors 818, 820 to cool and expand the compressed refrigerant stream 822 using, for example, a cooler 824 and expander 828, thereby forming the compressed, additionally cooled refrigerant stream 830; (13) routing the compressed, additionally cooled refrigerant stream 830 to the separator 832 to mix with the make-up gas stream 834 (which is a portion 888 of the chilled gas stream 886), to maintain the compressor suction pressure targets during start-up, where the separator 832 condenses excessive heavy hydrocarbon components from the compressed, additionally cooled refrigerant stream 830 and produces a gaseous overhead refrigerant stream 838; (14) passing the gaseous overhead refrigerant stream 838 through the first heat exchanger zone 801 to cool the chilled gas stream 886 by indirect heat exchange therewith in at least one heat exchanger contained therein, thereby forming a first warm refrigerant stream 808; (15) directing the first warm refrigerant stream to the second heat exchanger zone 810 where it exchanges heat with a compressed, cooled refrigerant stream 826 to additionally cool the compressed, cooled refrigerant stream 826, thereby forming a second warm refrigerant stream 809 and a compressed, additionally cooled refrigerant stream 829; (16) compressing the second warm refrigerant stream 809 in the at least one compressor 818, 820 to produce the compressed refrigerant stream 822; (17) gradually increasing the discharge pressure of at least one of the compressors 818, 820 to repeat steps (11)-(17) while adding feed gas through the make-up stream 834 to maintain suction pressure of primary compressor, thereby gradually increasing the primary cooling loop circulation rate; (18) starting the companders in the primary cooling loop 802 when the circulation rate in the primary cooling loop reaches the minimum required flow for compander operation; and (19) establishing steady state operation of the process with only the primary cooling loop refrigerant.

With regard to step (14), the feed gas rate in the first heat exchanger zone can range from 0 to a full process rate. In other words, as the primary cooling loop temperature gradually drops, the chilled gas rate will be 0 at the beginning, then will gradually turn on until the loop temperature is reduced to a desired level. It is also possible to have minimum flow in the first heat exchanger zone.

D. Start and Establish Sub-Cooling Loop Circulation

Starting and establishing circulation in the sub-cooling loop 804 includes the following steps: (20) starting compression unit 848 with minimum speed and full recycle through ASV, generating a suction pressure lower than, and a discharge pressure higher than, the pressurized pressure of the sub-cooling loop 804; (21) routing the sub-cooling refrigerant stream, which in a preferred aspect comprises nitrogen, to the first heat exchange zone 801 to warm at least part of the circulating primary refrigerant, thereby forming a cooled sub-cooling refrigerant stream; (22) gradually opening the sub-cooling circulation passage downstream of the cooled sub-cooling refrigerant stream to depressurize and chill, e.g., in an expander 846, the cooled sub-cooling refrigerant stream, thereby forming an expanded chilled sub-cooling refrigerant stream 844; (23) passing the expanded chilled sub-cooling refrigerant stream 844 to the first heat exchanger zone 801 to cool at least part of the chilled feed gas stream 886 by indirect heat exchange, thereby forming a warm sub-cooling refrigerant stream; (24) compressing the warm sub-cooling refrigerant stream in compression unit 848 to produce a re-compressed sub-cooling refrigerant stream; (25) gradually increasing the discharge pressure of compression unit 848; (26) adding sub-cooling coolant, such as nitrogen, to the sub-cooling loop refrigerant stream in the sub-cooling loop 804 to maintain the suction pressure targets during start-up; (27) starting companders in the sub-cooling loop 804 when circulation rates reach the minimum required flow for compander operation; and (28) establishing steady state operation of both the primary loop refrigerant and the sub-cooling loop refrigerant circulation rates at design pressures and turndown rate conditions.

E. Ramp Up Flow Rates

Ramping up flow rates includes the step of (29) gradually ramping up the feed gas rate and the circulation rates of the primary cooling loop and the sub-cooling loop to desired flow rates, which in one aspect comprises the design flow rates or the production flow rates of the liquefaction system 800.

Figure 9:
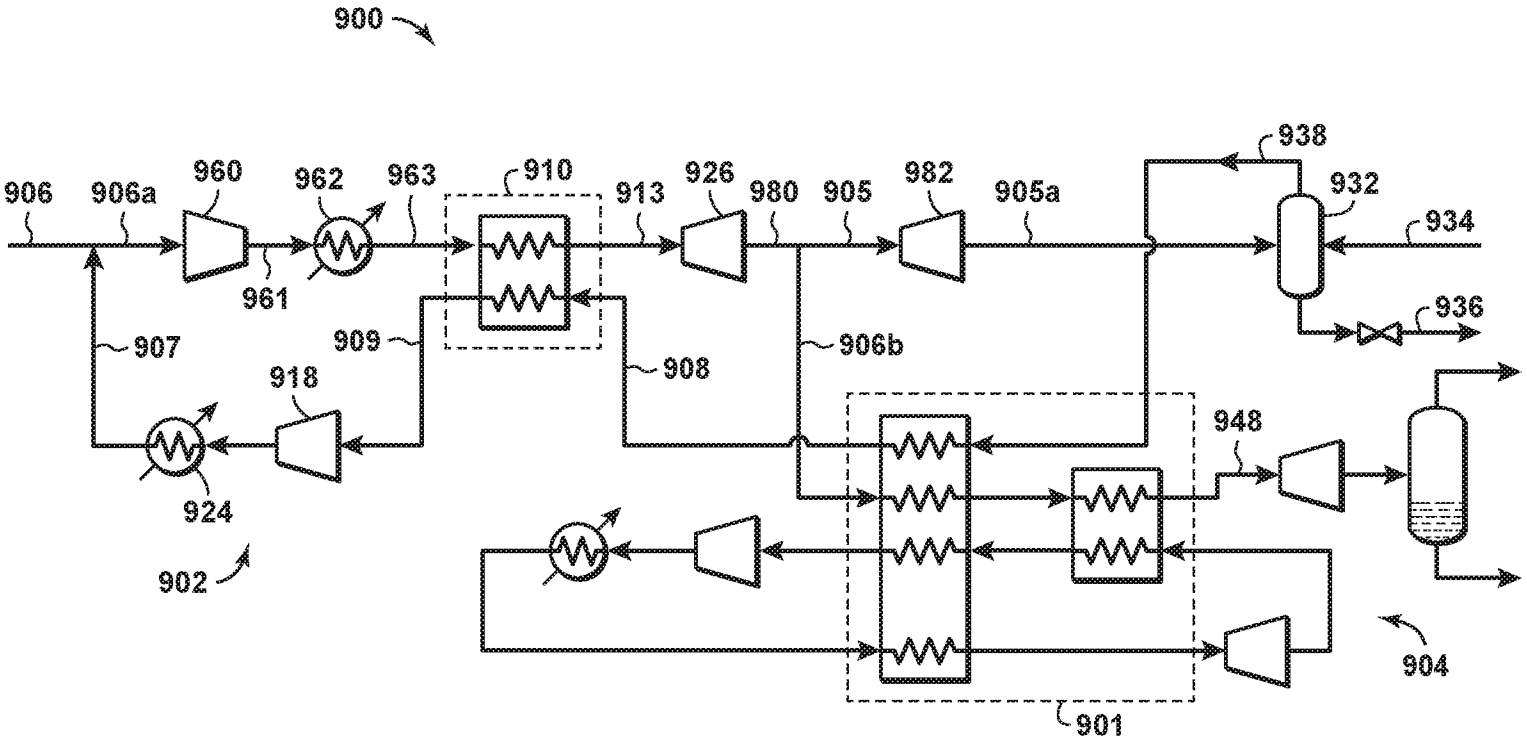
FIG. 9 is a schematic diagram of a system for LNG production according to disclosed aspects.

FIG. 9 is a schematic diagram that illustrates a liquefaction system 900 according to yet another aspect of the disclosure. Liquefaction system 900 contains similar structure and components with previously disclosed liquefaction systems and for the sake of brevity similarly depicted or numbered components may not be further described. Liquefaction system 900 includes a primary cooling loop 902 and a sub-cooling loop 904. Liquefaction system 900 also includes first and second heat exchanger zones 901, 910. In liquefaction system 900, the feed gas stream 906 is mixed with a refrigerant stream 907 to produce a second feed gas stream 906*a*. Using a compressor 960, the second feed gas stream 906*a* is compressed to a pressure greater than 1,500 psia, or more preferably, to a pressure of approximately 3,000 psia, to form a compressed second gas stream 961. Using an external cooling unit 962, the compressed second gas stream 961 is then cooled against an ambient cooling medium (air or water) to produce a compressed, cooled second gas stream 963. The compressed, cooled second gas stream 963 is directed to the second heat exchanger zone 910 where it exchanges heat with a first warm refrigerant stream 908, to produce a compressed, additionally cooled second gas stream 913 and a second warm refrigerant stream 909.

The compressed, additionally cooled second gas stream 913 is expanded in at least one work producing expander 926 to a pressure that is less than 2,000 psia, but no greater than the pressure to which the second gas stream 906*a* was compressed, to thereby form an expanded, cooled second gas stream 980. The expanded, cooled second gas stream 980 is separated into a first expanded refrigerant stream 905 and a chilled feed gas stream 906*b*. The first expanded refrigerant stream 905 may be near isentropically expanded using an expander 982 to form a second expanded refrigerant stream 905*a*, which is directed to a separation vessel 932. A make-up gas stream 934 also may be directed to the separation vessel 932 to mix therein with the expanded, cooled refrigerant stream 930. The rate at which the make-up gas stream 934 is added to the separation vessel 932 will depend on the rate of loss of refrigerant due to such factors as leaks from equipment seals. The mixing conditions the make-up gas stream 934 by condensing heavy hydrocarbon components (e.g., $C_{2+}$compounds) contained in the make-up gas stream 934. The condensed components accumulate in the bottom of the separator and are periodically discharged as a separator bottom stream 936 to maintain a desired liquid level in the separation vessel 932. The conditioned make-up gas stream, minus the condensed heavy hydrocarbon components, exits the separation vessel as a gaseous overhead refrigerant stream 938, which is directed to the first heat exchanger zone 901. The chilled feed gas stream 906*b* is directed to the first heat exchanger zone 901 where a primary cooling refrigerant (i.e., the gaseous overhead refrigerant stream 938) and a sub-cooling refrigerant (from the sub-cooling loop 904) are used to liquefy and sub-cool the chilled feed gas stream 906*b* to produce a sub-cooled gas stream 948, which is processed as previously described to form LNG. The sub-cooling loop 904 may be a closed refrigeration loop, preferably charged with nitrogen as the sub-cooling refrigerant. After exchanging heat with the chilled feed gas stream 906*b,* the gaseous overhead refrigerant stream 938 forms the first warm refrigerant stream 908. The first warm refrigerant stream 908 may have a temperature that is cooler by at least 5° F., or more preferably, cooler by at least 10° F., or more preferably, cooler by at least 15° F., than the highest fluid temperature within the first heat exchanger zone 901. The second warm refrigerant stream 909 is compressed in one or more compressors 918 and then cooled with an ambient cooling medium in an external cooling device 924 to produce the refrigerant stream 907.

Aspects of the disclosure illustrated in FIG. 9 demonstrate that the primary refrigerant stream may comprise part of the feed gas stream, which in a preferred aspect may be primarily or nearly all methane. Indeed, it may be advantageous for the refrigerant in the primary cooling loop of all the disclosed aspects (i.e., FIGS. 2 through 9) be comprised of at least 85% methane, or at least 90% methane, or at least 95% methane, or greater than 95% methane. This is because methane may be readily available in various parts of the disclosed processes, and the use of methane may eliminate the need to transport refrigerants to remote LNG processing locations. As a non-limiting example, the refrigerant in the primary cooling loop 202 in FIG. 2 may be taken through line 206*a* of the feed gas stream 206 if the feed gas is high enough in methane to meet the compositions as described above. Make-up gas may be taken from the sub-cooled gas stream 254 during normal operations. Alternatively, part or all of a boil-off gas stream 259 from an LNG storage tank 257 may be used to supply refrigerant for the primary cooling loop 202. Furthermore, if the feed gas stream is sufficiently low in nitrogen, part or all of the end flash gas stream 264 (which would then be low in nitrogen) may be used to supply refrigerant for the primary cooling loop 202. Lastly, any combination of line 206*a,* boil-off gas stream 259, and end flash gas stream 264 may be used to provide or even occasionally replenish the refrigerant in the primary cooling loop 202.

According to disclosed aspects, a start-up method for the system 900 shown in FIG. 9 will now be described. It should be understood that the start-up methods disclosed herein are applicable to other systems 200-800.

A. Pressurizing the Refrigerant Systems

Pressurizing the refrigerant system includes the following steps: (1) providing the feed gas stream 906 at a pressure less than 1,200 psia; (2) using compressor 960, pressurizing the sub-cooling loop 904 to at most 90% of the lowest design pressure of sub-cooling loop using nitrogen, then restricting or closing circulation thereafter; and (3) pressurizing the primary cooling loop 902 to a pressure of at most 90% of the lowest design pressure of primary cooling loop 902, by feeding the feed gas stream 906 to the primary loop, then restricting or closing the circulation thereafter.

B. Start and Establish Primary Cooling Loop Circulation

Starting and establishing circulation in the primary cooling loop 902 includes the following steps: (4) starting the compressor 960 with a minimum speed and full recycle through ASV, thereby generating a suction pressure lower than, and a discharge pressure higher than, the pressurized pressure of the primary cooling loop 902; (5) gradually permitting circulation in the primary cooling loop 902 downstream of compressor 960 to generate a compressed, cooled second gas stream 963, including exchanging heat with ambient water or ambient air in an external cooling unit 962, and then passing through the second heat exchanger zone 910 to be additionally cooled, thereby forming the compressed, additionally cooled second gas stream 913, which is expanded and depressurized in at least one work producing expander 926 to generate the expanded, cooled second gas stream 980; (6) separating the expanded, cooled second gas stream 980 into the first expanded refrigerant stream 905 and the chilled feed gas stream 906*b;* (7) expanding and depressurizing the first expanded refrigerant stream 905 in the expander 982 to produce the second expanded refrigerant stream 905*a;* (8) routing the second expanded refrigerant stream 905*a* to at least one separator 932, thereby condensing excessive heavy hydrocarbon components therefrom and producing the gaseous overhead refrigerant stream 938; (9) accumulating the heavy hydrocarbon components and periodically discharging the heavy hydrocarbon components as the separator bottom stream 936 to maintain a desired liquid level in the separator 932; (10) passing the gaseous overhead refrigerant stream 938 through the first heat exchanger zone 901 to cool at least part of the chilled feed gas stream 906*b* by indirect heat exchange, thereby forming the first warm refrigerant stream 908; (11) passing the first warm refrigerant stream 908 through the second heat exchanger zone 910 to cool at least part of the compressed, cooled second gas stream 963, thereby forming a second warm refrigerant stream 909; (12) compressing the second warm refrigerant stream in the compressor 918, to produce the refrigerant stream 906; (13) gradually increasing the discharge pressure of compressor 918 or 960 and continuing some or all of steps (6)-(12) while increasing the feed gas stream 906 to maintain suction pressure of compressor 918 or 960, thereby gradually increasing the circulation rate in the primary cooling loop 902; (14) starting companders in the primary cooling loop 902 when the circulation rate in the primary cooling loop reaches the minimum required flow for compander operation; and (15) establishing steady state operation of only the primary loop refrigerant.

C. Start and Establish Sub-Cooling Loop Circulation

Starting and establishing circulation in the sub-cooling loop 904 may include the following steps: (16) starting the compression unit 948 with minimum speed and full recycle through ASV, generating a suction pressure lower than, and discharge pressure higher than, the pressurized pressure of the sub-cooling loop 904; (17) routing the sub-cooling refrigerant stream, which in a preferred aspect comprises nitrogen, to the first heat exchanger zone 901 to warm at least part of the circulating primary refrigerant, thereby forming a cooled sub-cooling refrigerant stream; (18) gradually opening the sub-cooling circulation passage downstream of the cooled sub-cooling refrigerant stream to depressurize and chill, e.g., in an expander 946, the cooled sub-cooling refrigerant stream, thereby forming an expanded sub-cooling refrigerant stream 944; (19) passing the expanded sub-cooling refrigerant stream 944 to the first heat exchanger zone 901 to cool at least part of the chilled feed gas stream 906*b* by indirect heat exchange, thereby forming a warm sub-cooling refrigerant stream; (20) compressing the warm sub-cooling refrigerant stream in compression unit 948 to produce the compressed sub-cooling loop refrigerant; (21) gradually increasing the discharge pressure of compression unit 948; (22) adding sub-cooling coolant, such as nitrogen, to sub-cooling loop 904 to maintain the suction pressure targets of compression unit 948 during start-up; (23) starting companders in the sub-cooling loop 904 when circulation rates reach the minimum required flow for compander operation; and (24) establishing steady state operation with both primary loop refrigerant and sub-cooling loop refrigerant circulation rates at operating, or design, pressures and turndown rate conditions.

D. Ramp Up Flow Rates

Ramping up flow rates includes the step of (25) gradually ramping up the feed gas rate the circulation rates of the primary cooling loop and the sub-cooling loop to desired flow rates, which in one aspect comprises the design flow rate of the liquefaction system 900.

With regard to step (10), the feed gas rate in the first heat exchanger zone can range from 0 to a full process rate. In other words, as the primary cooling loop temperature gradually drops, the chilled gas rate will be 0 at the beginning, then will gradually turn on until the loop temperature is reduced to a desired level. It is also possible to have minimum flow in the first heat exchanger zone.

The methods and processes disclosed herein may be advantageously used for start-up operation of the disclosed LNG liquefaction systems. Normal operation of the disclosed LNG liquefaction systems are depicted and disclosed in co-pending U.S. Provisional Patent Application titled "Managing Make-up Gas Composition Variation for a High Pressure Expander Process", which is commonly owned and is filed on an even date herewith, the disclosure of which is incorporated by reference in its entirety.

Figure 10:
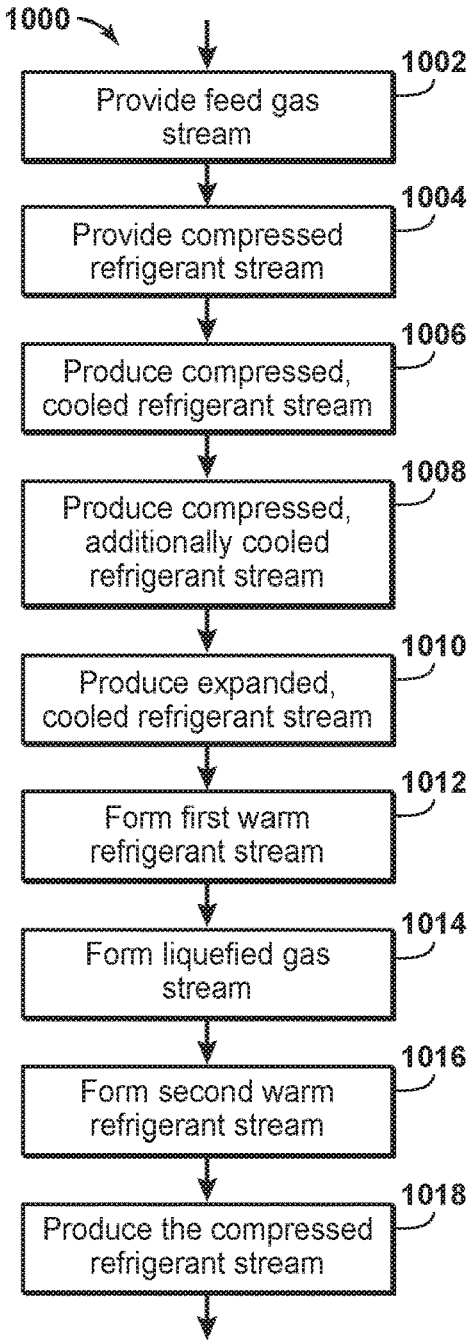
FIG. 10 is a flowchart of a method according to aspects of the disclosure.

FIG. 10 is a flowchart of a method 1000, according to disclosed aspects, for start-up of a system for liquefying a feed gas stream comprising natural gas. The system has a feed gas compression and expansion loop, and a refrigerant system comprising a primary cooling loop and a sub-cooling loop. At block 1002 the feed gas compression and expansion loop is started up. At block 1004 the refrigerant system is pressurized. At block 1006 circulation in the primary cooling loop is started and established. At block 1008 circulation in the sub-cooling loop is started and established. In block 1010 a flow rate of the feed gas stream and circulation rates of the primary cooling loop and the sub-cooling loop are ramped up. Each of the parts of the method represented by blocks 1002-1010 may include one or more steps as outlined herein.

Figure 11:
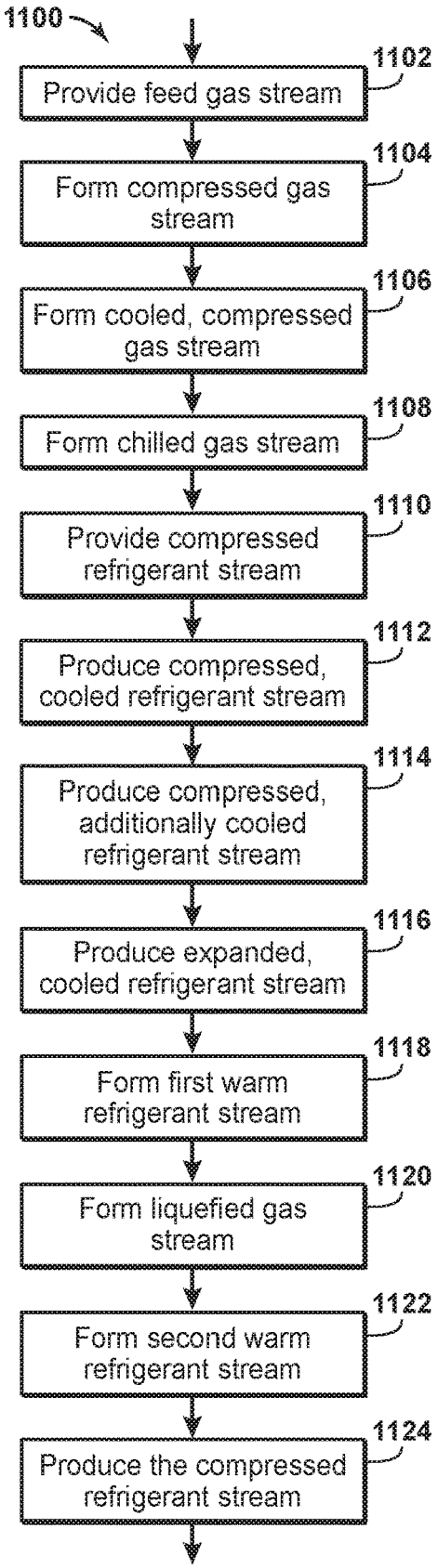
FIG. 11 is a flowchart of a method according to aspects of the disclosure.

FIG. 11 is a flowchart of a method 1100, according to disclosed aspects, for start-up of a system for liquefying a feed gas stream comprising natural gas. The system has a refrigerant system comprising a primary cooling loop and a sub-cooling loop. At block 1102 the refrigerant system is pressurized. At block 1104 circulation in the primary cooling loop is started and established. At block 1106 circulation in the sub-cooling loop is started and established. At block 1108 a flow rate of the feed gas stream and circulation rates of the primary cooling loop and the sub-cooling loop are ramped up. Each of the parts of the method represented by blocks 1102-1108 may include one or more steps as outlined herein.

The steps depicted in FIGS. 10-11 are provided for illustrative purposes only and a particular step may not be required to perform the disclosed methodology. Moreover, FIGS. 10-11 may not illustrate all the steps that may be performed. The claims, and only the claims, define the disclosed system and methodology.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method for start-up of a system for liquefying a feed gas stream comprising natural gas, the system having a refrigerant system comprising a primary cooling loop and a sub-cooling loop, the method comprising:

(a) pressurizing the refrigerant system, wherein step (a) comprises:

a1. providing the feed gas stream at a pressure less than 1,200 psia, and introducing a first portion of the feed gas stream to the primary cooling loop as a primary loop refrigerant;

a2. pressurizing a sub-cooling refrigerant in the sub-cooling loop to a sub-cooling loop pre-circulation pressure; and a3. pressurizing the first portion of the feed gas stream in the primary cooling loop to a primary cooling loop pre-circulation pressure;

(b) starting and establishing circulation of the primary loop refrigerant in the primary cooling loop, the primary loop refrigerant passing through at least one primary cooling loop compressor unit and reaching a primary cooling loop discharge pressure that is higher than the primary cooling loop pre-circulation pressure;

(c) starting and establishing circulation of the sub-cooling refrigerant in the sub-cooling loop, the sub-cooling refrigerant passing through a sub-cooling loop compressor unit and reaching a sub-cooling loop discharge pressure that is higher than the sub-cooling cooling loop pre-circulation pressure; and (d) after starting and establishing circulation in the primary cooling loop and in the sub-cooling loop, ramping up a flow rate of the first portion of the feed gas stream to the primary cooling loop and ramping up circulation rates within the primary cooling loop and the sub-cooling loop;

wherein a second portion of the feed gas stream undergoes indirect heat exchange with the primary loop refrigerant and the sub-cooling refrigerant in a heat exchanger zone.

2. The method of claim 1, wherein the sub-cooling refrigerant comprises nitrogen.

3. The method of claim 1, wherein step (c) comprises:

c1. starting the sub-cooling loop compressor unit with full recycle through an associated anti-surge valve (ASV);

c2. routing the sub-cooling refrigerant in the sub-cooling loop to a first heat exchanger within the heat exchanger zone to warm at least part of the primary loop refrigerant circulating in the primary cooling loop, thereby forming a cooled sub-cooling refrigerant;

c3. depressurizing and chilling the cooled sub-cooling refrigerant to form an expanded sub-cooling refrigerant;

c4. passing the expanded sub-cooling refrigerant sequentially to a second heat exchanger and the first heat exchanger within the heat exchanger zone to cool the second portion of the feed gas stream by indirect heat exchange, thereby forming a warmed sub-cooling refrigerant and a sub-cooled feed gas stream;

c5. compressing the warmed sub-cooling refrigerant in the sub-cooling loop compressor unit to produce a compressed sub-cooling loop refrigerant;

c6. increasing the discharge pressure of the sub-cooling loop compressor unit;

c7. adding further sub-cooling refrigerant to the sub-cooling loop while establishing circulation of the sub-cooling refrigerant in the sub-cooling loop;

c8. starting companders in the sub-cooling loop when a circulation rate within the sub-cooling loop reaches a required flow for compander operation; and c9. establishing steady state operation of the system after ramping up the circulation rate of the primary loop refrigerant and the circulation rate of the sub-cooling loop refrigerant.

* * * * *